US010529351B2

(12) United States Patent
Wang et al.

(10) Patent No.: US 10,529,351 B2
(45) **Date of Patent: *Jan. 7, 2020**

(54) METHOD AND APPARATUS FOR RECOVERING LOST FRAMES

(71) Applicant: HUAWEI TECHNOLOGIES CO., LTD., Shenzhen, Guangdong (CN)

(72) Inventors: Bin Wang, Beijing (CN); Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/396,253

(22) Filed: Apr. 26, 2019

(65) Prior Publication Data

US 2019/0251980 A1 Aug. 15, 2019

Related U.S. Application Data

(63) Continuation of application No. 15/817,296, filed on Nov. 20, 2017, which is a continuation of application No. 15/385,881, filed on Dec. 21, 2016, now Pat. No. 9,852,738, which is a continuation of application No. PCT/CN2015/071728, filed on Jan. 28, 2015.

(30) Foreign Application Priority Data

Jun. 25, 2014 (CN) ..... 2014 1 0291123

(51) Int. Cl.
*G10L 19/083* (2013.01)
*G10L 21/0388* (2013.01)
(Continued)

(52) U.S. Cl.
CPC ..... *G10L 19/083* (2013.01); *G10L 19/005* (2013.01); *G10L 19/0204* (2013.01);
(Continued)

(58) Field of Classification Search
CPC .. G10L 19/005; G10L 21/038; G10L 21/0388
See application file for complete search history.

(56) References Cited

U.S. PATENT DOCUMENTS 5,450,449 A 9/1995 Kroon
5,699,485 A 12/1997 Shoham
(Continued)

FOREIGN PATENT DOCUMENTS

CA 2865533 9/2013
CN 1984203 6/2007
(Continued)

OTHER PUBLICATIONS

G. 729-based embedded variable bit-rate coder: An 8-32 kbiUs scalable wideband coder bitstream interoperable with G. 729. ITU-T Recommendation G. 729.1. May 2006. total 100 pages.
(Continued)

*Primary Examiner* — Eric Yen
(74) *Attorney, Agent, or Firm* — Fish & Richardson P.C.

(57) ABSTRACT

The present disclosure relates methods and apparatus for recovering a lost frame in a received audio signal. One example method includes obtaining an initial high-frequency band signal of a current lost frame in the received audio signal, calculating a ratio R, where the ratio R is a ratio of a high frequency excitation energy of a previous frame of the current lost frame to a high frequency excitation energy of the current lost frame, obtaining a global gain of the current lost frame according to the ratio R and a global gain of the previous frame of the current lost frame, and recovering a high-frequency band signal of the current lost frame according to the initial high-frequency band signal of the current lost frame and the global gain of the current lost frame.

16 Claims, 6 Drawing Sheets

(51) Int. Cl.

| | |
|---|---|
| ***G10L 21/038*** | (2013.01) |
| ***G10L 19/005*** | (2013.01) |
| ***G10L 19/02*** | (2013.01) |
| ***G10L 25/93*** | (2013.01) |
| ***G10L 19/24*** | (2013.01) |

(52) U.S. Cl.

CPC ..... *G10L 21/038* (2013.01); *G10L 21/0388* (2013.01); *G10L 25/93* (2013.01); *G10L 19/24* (2013.01); *G10L 2025/932* (2013.01)

(56) References Cited

U.S. PATENT DOCUMENTS

| | | | | |
|---|---|---|---|---|
| 5,819,217 | A | 10/1998 | Raman | |
| 6,006,178 | A * | 12/1999 | Taumi | G10L 19/083 704/219 |
| 6,260,010 | B1 | 7/2001 | Gao et al. | |
| 6,418,408 | B1 | 7/2002 | Uda Ya Bhaskar et al. | |
| 6,438,513 | B1 | 8/2002 | Pastor et al. | |
| 6,574,593 | B1 | 6/2003 | Gao et al. | |
| 6,636,829 | B1 * | 10/2003 | Benyassine | G10L 19/005 704/201 |
| 6,732,075 | B1 | 5/2004 | Omori et al. | |
| 7,457,757 | B1 | 11/2008 | McNeill et al. | |
| 7,693,710 | B2 | 4/2010 | Jelinek et al. | |
| 8,010,351 | B2 | 8/2011 | Gao | |
| 8,069,038 | B2 | 11/2011 | Malah et al. | |
| 8,180,064 | B1 * | 5/2012 | Avendano | G10L 21/0232 381/71.1 |
| 8,185,388 | B2 | 5/2012 | Gao | |
| 8,355,911 | B2 | 1/2013 | Zhan et al. | |
| 8,457,115 | B2 | 6/2013 | Zhan et al. | |
| 9,450,555 | B2 | 9/2016 | Sorensen et al. | |
| 2002/0097807 | A1 | 7/2002 | Gerrits | |
| 2002/0184010 | A1 | 12/2002 | Eriksson et al. | |
| 2003/0200092 | A1 | 10/2003 | Gao et al. | |
| 2004/0039464 | A1 | 2/2004 | Virolainen et al. | |
| 2004/0064308 | A1 | 4/2004 | Deisher | |
| 2004/0068399 | A1 | 4/2004 | Ding | |
| 2004/0107090 | A1 | 6/2004 | Oh et al. | |
| 2004/0128128 | A1 | 7/2004 | Wang et al. | |
| 2004/0166820 | A1 | 8/2004 | Sluijter et al. | |
| 2005/0004793 | A1 | 1/2005 | Ojala et al. | |
| 2005/0149339 | A1 | 7/2005 | Tanaka et al. | |
| 2005/0154584 | A1 | 7/2005 | Jelinek et al. | |
| 2006/0020450 | A1 | 1/2006 | Miseki | |
| 2006/0262851 | A1 | 11/2006 | Bakfan et al. | |
| 2006/0271359 | A1 | 11/2006 | Khalil et al. | |
| 2006/0277039 | A1 | 12/2006 | Vos et al. | |
| 2007/0033029 | A1 | 2/2007 | Sakawaki | |
| 2007/0067163 | A1 * | 3/2007 | Kabal | G10L 21/038 704/207 |
| 2008/0027715 | A1 | 1/2008 | Rajendran et al. | |
| 2008/0033718 | A1 | 2/2008 | Zopf et al. | |
| 2008/0040120 | A1 | 2/2008 | Kurniawati et al. | |
| 2008/0046233 | A1 | 2/2008 | Chen et al. | |
| 2008/0065376 | A1 * | 3/2008 | Osada | G10L 19/035 704/230 |
| 2008/0071530 | A1 | 3/2008 | Ehara | |
| 2008/0077399 | A1 | 3/2008 | Yoshida | |
| 2008/0126082 | A1 | 5/2008 | Ehara et al. | |
| 2008/0208575 | A1 | 8/2008 | Lmksonen et al. | |
| 2008/0312914 | A1 | 12/2008 | Rajendran et al. | |
| 2009/0061785 | A1 | 3/2009 | Kawashima et al. | |
| 2009/0076808 | A1 | 3/2009 | Xu et al. | |
| 2009/0089050 | A1 | 4/2009 | Mo et al. | |
| 2009/0141790 | A1 | 6/2009 | Kawashima et al. | |
| 2009/0210237 | A1 | 8/2009 | Shen et al. | |
| 2009/0316598 | A1 | 12/2009 | Zhan et al. | |
| 2010/0057449 | A1 | 3/2010 | Lee et al. | |
| 2010/0094642 | A1 | 4/2010 | Zhan et al. | |
| 2010/0191522 | A1 | 7/2010 | Zhang et al. | |
| 2010/0286805 | A1 | 11/2010 | Gao et al. | |
| 2010/0312553 | A1 | 12/2010 | Fang et al. | |
| 2011/0007827 | A1 | 1/2011 | Virette et al. | |
| 2011/0035213 | A1 | 2/2011 | Malenovsky et al. | |
| 2011/0112668 | A1 | 5/2011 | Sorensen et al. | |
| 2011/0125505 | A1 | 5/2011 | Vaillancourt et al. | |
| 2012/0065984 | A1 | 3/2012 | Yamanashi et al. | |
| 2012/0109659 | A1 | 5/2012 | Wu et al. | |
| 2012/0121096 | A1 | 5/2012 | Chen et al. | |
| 2012/0209599 | A1 | 8/2012 | Malenovsky | |
| 2013/0144615 | A1 | 6/2013 | Rauhala et al. | |
| 2013/0166287 | A1 | 6/2013 | Gao | |
| 2013/0253939 | A1 | 9/2013 | Tsutsumi et al. | |
| 2013/0332152 | A1 | 12/2013 | Lecomte et al. | |
| 2013/0339038 | A1 | 12/2013 | Norvell et al. | |
| 2014/0142957 | A1 | 5/2014 | Sung et al. | |
| 2014/0229171 | A1 | 8/2014 | Atti et al. | |
| 2014/0236585 | A1 | 8/2014 | Subasingha et al. | |
| 2014/0337039 | A1 | 11/2014 | Guan | |
| 2015/0036679 | A1 | 2/2015 | Deng et al. | |
| 2015/0131429 | A1 | 5/2015 | Liu et al. | |
| 2015/0170655 | A1 | 6/2015 | Li et al. | |
| 2015/0255074 | A1 * | 9/2015 | Jeong | G10L 19/005 704/500 |
| 2015/0317994 | A1 | 11/2015 | Ramadas et al. | |
| 2016/0019898 | A1 | 1/2016 | Schreiner et al. | |
| 2016/0329060 | A1 | 11/2016 | Ito et al. | |

FOREIGN PATENT DOCUMENTS

| | | |
|---|---|---|
| CN | 1989548 | 6/2007 |
| CN | 101155140 | 4/2008 |
| CN | 101321033 | 12/2008 |
| CN | 101325537 | 12/2008 |
| CN | 1983909 | 7/2010 |
| CN | 102915737 | 2/2013 |
| CN | 101286319 | 5/2013 |
| CN | 103854649 | 6/2014 |
| EP | 1898397 | 3/2008 |
| JP | H09134198 | 5/1997 |
| JP | 2005534950 | 11/2005 |
| JP | 2009175693 | 8/2009 |
| JP | 2011515712 | 5/2011 |
| KR | 20050061615 | 6/2005 |
| RU | 2488899 | 7/2013 |
| WO | 2006098274 | 9/2006 |
| WO | 2007000988 | 1/2007 |
| WO | 2012070370 | 5/2012 |
| WO | 2013060223 | 5/2013 |
| WO | 2014012391 | 1/2014 |
| WO | 2014051964 | 4/2014 |

OTHER PUBLICATIONS

ITU-T Recommendation. G.718. Frame error robust narrow-band and wideband embedded variable bit-rate coding of speech and audio from 8-32 kbiUs. ITU-T, Jun. 2008. total 257 pages.

XP017538626. France Telecom G729EV Candidate: high level description and complexity evaluation, France Telecom. ITU-T draft. Jul. 26-Aug. 5, 2005. total 12 pages.

XP062013690. 3GPP2 C.S0014-E v1.0, "Enhanced Variable Rate Codec, Speech Service Options 3, 68, 70, 73 and 77 for Wideband Spread Spectrum Digital Systems", Dec. 2011, total 358 pages.

XP55147503.ITU-T G.722, Series G: Transmission Systems and Media, Digital System and Networks, "7 kHz audio-coding within 64 kbiUs", ITU-T Recommendation G.722, Sep. 16, 2012, pp. 1-262.

G 722:"ITU-T G.722 7khz audio-coding within 64 kbiUs", ITU-T Recommendation, Sep. 16, 2012, total 274 pages.

International Telecommunication Union, "Series G: Transmission Systems and Media, Digital Systems and Networks: Digital Terminal Equipments—Coding of Voice and Audio Signals," ITU-T—G. 722, 7kHz audo-coding within 64 kbits, Sep. 16, 2012, XP55147503, 262 pages.

(56) References Cited

OTHER PUBLICATIONS

Examination Report issued in Indian Application No. 201627038307 dated Apr. 24, 2019, 7 pages.

* cited by examiner

METHOD AND APPARATUS FOR RECOVERING LOST FRAMES

CROSS-REFERENCE TO RELATED APPLICATIONS

This application is a continuation of U.S. patent application Ser. No. 15/817,296, filed on Nov. 20, 2017, which is a continuation of U.S. patent application Ser. No. 15/385,881, filed on Dec. 21, 2016, now U.S. Pat. No. 9,852,738 which is a continuation of International Application No. PCT/CN2015/071728, filed on Jan. 28, 2015. The International Application claims priority to Chinese Patent Application No. 201410291123.5, filed on Jun. 25, 2014. All of the afore-mentioned patent applications are hereby incorporated by reference in their entireties.

TECHNICAL FIELD

Embodiments of the present application relate to the field of communications technologies, and in particular, to a method and an apparatus for recovering lost frames.

BACKGROUND

With development of communications technologies, users are requiring increasingly higher quality in voice calls, and a main method for improving voice call quality is increasing bandwidth of a voice signal. If a conventional coding scheme is used for encoding to increase bandwidth of a voice signal, bit rates would be greatly increased. However, a higher bit rate requires larger network bandwidth to transmit the voice signal. Due to constrains of network bandwidth, it is difficult to put into practice a method that increases voice signal bandwidth by increasing a bit rate.

Currently, in order to encode a voice signal with wider bandwidth when a bit rate is unchanged or only changes slightly, bandwidth extension technologies are mainly used. Bandwidth extension technologies include a time domain bandwidth extension technology and a frequency domain bandwidth extension technology. In addition, in a process of transmitting a voice signal, a packet loss rate is a key factor that affects quality of the voice signal. Therefore, how to recover a lost frame as correctly as possible when a packet loss occurs, to make signal transition more natural and more stable when a frame loss occurs is an important technology of voice signal transmission.

However, when a bandwidth extension technology is used, if a frame loss occurs in a voice signal, existing lost frame recovery methods may cause discontinuous transition between a recovered lost frame and frames before and after the recovered lost frame, which causes noise in the voice signal.

SUMMARY

Embodiments of the present application provide a method and an apparatus for recovering a lost frame, which are used to improve performance in recovery of a lost frame of an audio signal.

A first aspect provides a method for recovering a lost frame, including:

determining an initial high-band signal of a current lost frame;

determining a gain of the current lost frame;

determining gain adjustment information of the current lost frame, where the gain adjustment information includes at least one of the following:

a class of the current lost frame, a low-band signal spectral tilt of the current lost frame, a low-band signal energy of the current lost frame, and a quantity of consecutive lost frames, where the quantity of consecutive lost frames is a quantity of consecutive frames that are lost end with the current lost frame;

adjusting the gain of the current lost frame according to the gain adjustment information, to obtain an adjusted gain of the current lost frame; and adjusting the initial high-band signal according to the adjusted gain, to obtain a high-band signal of the current lost frame.

With reference to the first aspect, in a first possible implementation manner of the first aspect, the gain adjustment information includes a low-band signal energy of the current lost frame, and the adjusting the gain of the current lost frame according to the gain adjustment information, to obtain an adjusted gain of the current lost frame includes:

obtaining an energy ratio of a low-band signal energy of the current lost frame to a low-band signal energy of a previous frame of the current lost frame according to the low-band signal energy of the current lost frame; and adjusting the gain of the current lost frame according to the energy ratio of the low-band signal energy of the current lost frame to the low-band signal energy of the previous frame of the current lost frame, to obtain the adjusted gain of the current lost frame.

With reference to the first aspect, in a second possible implementation manner of the first aspect, the gain adjustment information includes a class of the current lost frame, a low-band signal spectral tilt of the current lost frame, a low-band signal energy of the current lost frame, and a quantity of consecutive lost frames, and the adjusting the gain of the current lost frame according to the gain adjustment information, to obtain an adjusted gain of the current lost frame includes:

when the quantity of consecutive lost frames is equal to 1, and a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, obtaining an energy ratio of a high frequency excitation energy of the previous frame of the current lost frame to a high frequency excitation energy of the current lost frame according to the low-band signal energy of the current lost frame; and adjusting the gain of the current lost frame according to the energy ratio of the high frequency excitation energy of the previous frame of the current lost frame to the high frequency excitation energy of the current lost frame, to obtain the adjusted gain of the current lost frame.

With reference to the first aspect, in a third possible implementation manner of the first aspect, the gain adjustment information includes a class of the current lost frame, a low-band signal spectral tilt of the current lost frame, a low-band signal energy of the current lost frame, and a quantity of consecutive lost frames, and the adjusting the gain of the current lost frame according to the gain adjustment information, to obtain an adjusted gain of the current lost frame includes:

when the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, and a low-band signal spectral tilt of the current lost frame is greater than the low-band signal spectral tilt of the previous frame of the current lost frame, adjusting the gain of the current lost frame according to a preset adjustment factor, to obtain the adjusted gain of the current lost frame.

With reference to the first aspect, in a fourth possible implementation manner of the first aspect, the gain adjustment information includes a class of the current lost frame, a low-band signal spectral tilt of the current lost frame, and a quantity of consecutive lost frames, and the adjusting the gain of the current lost frame according to the gain adjustment information, to obtain an adjusted gain of the current lost frame includes:

when the quantity of consecutive lost frames is equal to 1, and a class of the current lost frame is not unvoiced, a low-band signal spectral tilt of a previous frame of the current lost frame is greater than a first threshold, and an energy ratio of a low-band signal energy of the current lost frame to a low-band signal energy of the previous frame of the current lost frame is within a preset interval, obtaining an energy ratio of a high frequency excitation energy of the previous frame of the current lost frame to a high frequency excitation energy of the current lost frame according to the low-band signal energy of the current lost frame; and adjusting the gain of the current lost frame according to the energy ratio of the high frequency excitation energy of the previous frame of the current lost frame to the high frequency excitation energy of the current lost frame, to obtain the adjusted gain of the current lost frame.

With reference to the first aspect, in a fifth possible implementation manner of the first aspect, the gain adjustment information includes a quantity of consecutive lost frames, and the adjusting the gain of the current lost frame according to the gain adjustment information, to obtain an adjusted gain of the current lost frame includes:

obtaining an energy ratio of a high frequency excitation energy of a previous frame of the current lost frame to a high frequency excitation energy of the current lost frame according to a low-band signal energy of the current lost frame; and when the quantity of consecutive lost frames is greater than 1 and the energy ratio of the high frequency excitation energy of the previous frame of the current lost frame to the high frequency excitation energy of the current lost frame is greater than the gain of the current lost frame, adjusting the gain of the current lost frame according to the energy ratio of the high frequency excitation energy of the previous frame of the current lost frame to the high frequency excitation energy of the current lost frame, to obtain the adjusted gain of the current lost frame.

With reference to the first aspect, in a sixth possible implementation manner of the first aspect, the gain adjustment information includes a quantity of consecutive lost frames and a low-band signal spectral tilt of the current lost frame, and the adjusting the gain of the current lost frame according to the gain adjustment information, to obtain an adjusted gain of the current lost frame includes:

obtaining an energy ratio of a high frequency excitation energy of a previous frame of the current lost frame to a high frequency excitation energy of the current lost frame according to a low-band signal energy of the current lost frame; and when the quantity of consecutive lost frames is greater than 1, the energy ratio of the high frequency excitation energy of the previous frame of the current lost frame to the high frequency excitation energy of the current lost frame is greater than the gain of the current lost frame, and the low-band signal spectral tilt of the current lost frame and a low-band signal spectral tilt of the previous frame of the current lost frame are both greater than a second threshold, adjusting the gain of the current lost frame according to the energy ratio of the high frequency excitation energy of the previous frame of the current lost frame to the high frequency excitation energy of the current lost frame, to obtain the adjusted gain of the current lost frame.

With reference to any one possible implementation manner of the first aspect to the sixth possible implementation manner of the first aspect, in a seventh possible implementation manner of the first aspect, after the determining gain adjustment information of the current lost frame, the method further includes:

determining an initial excitation adjustment factor;

adjusting the initial excitation adjustment factor according to the gain adjustment information, to obtain an adjusted excitation adjustment factor; and the adjusting the initial high-band signal according to the adjusted gain, to obtain a high-band signal of the current lost frame includes:

adjusting the initial high-band signal according to the adjusted gain and the adjusted excitation adjustment factor, to obtain the high-band signal of the current lost frame.

With reference to the seventh possible implementation manner of the first aspect, in an eighth possible implementation manner of the first aspect, the gain adjustment information includes a class of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is equal to 1, a high frequency excitation energy of the current lost frame is greater than a high frequency excitation energy of a previous frame of the current lost frame, and a class of the current lost frame is not unvoiced and a class of a last normally received frame before the current lost frame is not unvoiced, adjusting the initial excitation adjustment factor according to a low-band signal energy of the previous frame of the current lost frame and a low-band signal energy of the current lost frame, to obtain the adjusted excitation adjustment factor.

With reference to the seventh possible implementation manner of the first aspect, in a ninth possible implementation manner of the first aspect, the gain adjustment information includes a class of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is equal to 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of the previous frame of the current lost frame is unvoiced, adjusting the initial excitation adjustment factor according to the low-band signal energy of the previous frame of the current lost frame and the low-band signal energy of the current lost frame, to obtain the adjusted excitation adjustment factor.

With reference to the seventh possible implementation manner of the first aspect, in a tenth possible implementation manner of the first aspect, the gain adjustment information includes a class of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is equal to 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of a last normally received frame before the current lost frame is unvoiced, adjusting the initial excitation adjustment factor according to the low-band signal energy of the previous frame of the current lost frame and the low-band signal energy of the current lost frame, to obtain the adjusted excitation adjustment factor.

With reference to the seventh possible implementation manner of the first aspect, in an eleventh possible implementation manner of the first aspect, the gain adjustment information includes a low-band spectral tilt of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is equal to 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a low-band signal spectral tilt of the previous frame of the current lost frame is greater than a third threshold, adjusting the initial excitation adjustment factor according to the low-band signal energy of the previous frame of the current lost frame and the low-band signal energy of the current lost frame, to obtain the adjusted excitation adjustment factor.

With reference to the seventh possible implementation manner of the first aspect, in a twelfth possible implementation manner of the first aspect, the gain adjustment information includes a low-band signal energy of the current lost frame and a quantity of consecutive lost frames, and the adjusting the initial excitation adjustment factor according to the gain adjustment information, to obtain an adjusted excitation adjustment factor includes:

when the quantity of consecutive lost frames is greater than 1, and high frequency excitation energy of the current lost frame is greater than a high frequency excitation energy of a previous frame of the current lost frame, adjusting the initial excitation adjustment factor according to a low-band signal energy of the previous frame of the current lost frame and a low-band signal energy of the current lost frame, to obtain the adjusted excitation adjustment factor.

With reference to the seventh possible implementation manner of the first aspect, in a thirteenth possible implementation manner of the first aspect, the gain adjustment information includes a class of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of the previous frame of the current lost frame is unvoiced, adjusting the initial excitation adjustment factor according to the low-band signal energy of the previous frame of the current lost frame and the low-band signal energy of the current lost frame, to obtain the adjusted excitation adjustment factor.

With reference to the seventh possible implementation manner of the first aspect, in a fourteenth possible implementation manner of the first aspect, the gain adjustment information includes a class of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of a last normally received frame before the current lost frame is unvoiced, adjusting the initial excitation adjustment factor according to the low-band signal energy of the previous frame of the current lost frame and the low-band signal energy of the current lost frame, to obtain the adjusted excitation adjustment factor.

With reference to the seventh possible implementation manner of the first aspect, in a fifth possible implementation manner of the first aspect, the gain adjustment information includes a low-band spectral tilt of the current lost frame, a low-band signal energy of the current lost frame, and a quantity of consecutive lost frames, and the adjusting the initial excitation adjustment factor according to the gain adjustment information, to obtain an adjusted excitation adjustment factor includes:

when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a low-band signal spectral tilt of the previous frame of the current lost frame is greater than a third threshold, adjusting the initial excitation adjustment factor according to the low-band signal energy of the previous frame of the current lost frame and the low-band signal energy of the current lost frame, to obtain the adjusted excitation adjustment factor.

A second aspect provides an apparatus for recovering a lost frame, where the apparatus for recovering a lost frame includes:

a determining module, configured to determine an initial high-band signal of a current lost frame; determine a gain of the current lost frame; and determine gain adjustment information of the current lost frame, where the gain adjustment information includes at least one of the following: a class of the current lost frame, a low-band signal spectral tilt of the current lost frame, a low-band signal energy of the current lost frame, and a quantity of consecutive lost frames, where the quantity of consecutive lost frames is a quantity of consecutive frames that are lost end with the current lost frame; and an adjustment module, configured to adjust the gain of the current lost frame according to the gain adjustment information, to obtain an adjusted gain of the current lost frame; and adjust the initial high-band signal according to the adjusted gain, to obtain a high-band signal of the current lost frame.

With reference to the second aspect, in a first possible implementation manner of the second aspect, the gain adjustment information includes a low-band signal energy of the current lost frame, and the adjustment module is configured to obtain an energy ratio of a low-band signal energy of the current lost frame to a low-band signal energy of a previous frame of the current lost frame according to the low-band signal energy of the current lost frame; and adjust the gain of the current lost frame according to the energy ratio of the low-band signal energy of the current lost frame to the low-band signal energy of the previous frame of the current lost frame, to obtain the adjusted gain of the current lost frame.

With reference to the second aspect, in a second possible implementation manner of the second aspect, the gain adjustment information includes a class of the current lost frame, a low-band signal spectral tilt of the current lost frame, a low-band signal energy of the current lost frame, and a quantity of consecutive lost frames, and the adjustment module is configured to: when the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, obtain an energy ratio of a high frequency excitation energy of the previous frame of the current lost frame to a high frequency excitation energy of the current lost frame according to the low-band signal energy of the current lost frame; and adjust the gain of the current lost frame according to the energy ratio of the high frequency excitation energy of the previous frame of the current lost frame to the high frequency excitation energy of the current lost frame, to obtain the adjusted gain of the current lost frame.

With reference to the second aspect, in a third possible implementation manner of the second aspect, the gain adjustment information includes a class of the current lost frame, a low-band signal spectral tilt of the current lost frame, a low-band signal energy of the current lost frame, and a quantity of consecutive lost frames, and the adjustment module is configured to: when the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, and a low-band signal spectral tilt of the current lost frame is greater than the low-band signal spectral tilt of the previous frame of the current lost frame, adjust the gain of the current lost frame according to a preset adjustment factor, to obtain the adjusted gain of the current lost frame.

With reference to the second aspect, in a fourth possible implementation manner of the second aspect, the gain adjustment information includes a class of the current lost frame, a low-band signal spectral tilt of the current lost frame, and a quantity of consecutive lost frames, and the adjustment module is configured to: when the quantity of consecutive lost frames is equal to 1, and a class of the current lost frame is not unvoiced, a low-band signal spectral tilt of a previous frame of the current lost frame is greater than a first threshold, and an energy ratio of a low-band signal energy of the current lost frame to a low-band signal energy of the previous frame of the current lost frame is within a preset interval, obtain an energy ratio of a high frequency excitation energy of the previous frame of the current lost frame to a high frequency excitation energy of the current lost frame according to the low-band signal energy of the current lost frame; and adjust the gain of the current lost frame according to the energy ratio of the high frequency excitation energy of the previous frame of the current lost frame to the high frequency excitation energy of the current lost frame, to obtain the adjusted gain of the current lost frame.

With reference to the second aspect, in a fifth possible implementation manner of the second aspect, the gain adjustment information includes a quantity of consecutive lost frames, and the adjustment module is configured to: obtain an energy ratio of a high frequency excitation energy of a previous frame of the current lost frame to a high frequency excitation energy of the current lost frame according to a low-band signal energy of the current lost frame; and when the quantity of consecutive lost frames is greater than 1 and the energy ratio of the high frequency excitation energy of the previous frame of the current lost frame to the high frequency excitation energy of the current lost frame is greater than the gain of the current lost frame, adjust the gain of the current lost frame according to the energy ratio of the high frequency excitation energy of the previous frame of the current lost frame to the high frequency excitation energy of the current lost frame, to obtain the adjusted gain of the current lost frame.

With reference to the second aspect, in a sixth possible implementation manner of the second aspect, the gain adjustment information includes a quantity of consecutive lost frames and a low-band signal spectral tilt of the current lost frame, and the adjustment module is configured to obtain an energy ratio of a high frequency excitation energy of a previous frame of the current lost frame to a high frequency excitation energy of the current lost frame according to a low-band signal energy of the current lost frame; and when the quantity of consecutive lost frames is greater than 1, the energy ratio of the high frequency excitation energy of the previous frame of the current lost frame to the high frequency excitation energy of the current lost frame is greater than the gain of the current lost frame, and the low-band signal spectral tilt of the current lost frame and a low-band signal spectral tilt of the previous frame of the current lost frame are both greater than a second threshold, adjust the gain of the current lost frame according to the energy ratio of the high frequency excitation energy of the previous frame of the current lost frame to the high frequency excitation energy of the current lost frame, to obtain the adjusted gain of the current lost frame.

With reference to any one possible implementation manner of the second aspect to the sixth possible implementation manner of the second aspect, in a seventh possible implementation manner of the second aspect, the determining module is further configured to determine an initial excitation adjustment factor; and the adjustment module is further configured to adjust the initial excitation adjustment factor according to the gain adjustment information, to obtain an adjusted excitation adjustment factor; and adjust the initial high-band signal according to the adjusted gain and the adjusted excitation adjustment factor, to obtain the high-band signal of the current lost frame.

With reference to the seventh possible implementation manner of the second aspect, in an eighth possible implementation manner of the second aspect, the gain adjustment information includes a class of the current lost frame, a low-band signal energy of the current lost frame, and a quantity of consecutive lost frames, and the adjustment module is configured to: when the quantity of consecutive lost frames is equal to 1, a high frequency excitation energy of the current lost frame is greater than a high frequency excitation energy of a previous frame of the current lost frame, a class of the current lost frame is not unvoiced, and a class of a last normally received frame before the current lost frame is not unvoiced, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in a ninth possible implementation manner of the second aspect, the gain adjustment information includes a class of the current lost frame, a low-band signal energy of the current lost frame, and a quantity of consecutive lost frames, and the adjustment module is configured to: when the quantity of consecutive lost frames is equal to 1, a high frequency excitation energy of the current lost frame is less than half a high frequency excitation energy of a previous frame of the current lost frame, an energy ratio of the frequency band signal energy of the current lost frame to a low-band signal energy of the previous frame of the current lost frame is within a preset interval, and a class of the previous frame of the current lost frame is unvoiced, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in a tenth possible implementation manner of the second aspect, the gain adjustment information includes a class of the current lost frame, a low-band signal energy of the current lost frame, and a quantity of consecutive lost frames, and the adjustment module is configured to: when the quantity of consecutive lost frames is equal to 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of a last normally received frame before the current lost frame is unvoiced, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in an eleventh possible implementation manner of the second aspect, the gain adjustment information includes a low-band spectral tilt of the current lost frame, a low-band signal energy of the current lost frame, and a quantity of consecutive lost frames, and the adjustment module is configured to: when the quantity of consecutive lost frames is equal to 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a low-band signal spectral tilt of the previous frame of the current lost frame is greater than a third threshold, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in a twelfth possible implementation manner of the second aspect, the gain adjustment information includes a low-band signal energy of the current lost frame and a quantity of consecutive lost frames, and the adjustment module is configured to: when the quantity of consecutive lost frames is greater than 1, and high frequency excitation energy of the current lost frame is greater than a high frequency excitation energy of a previous frame of the current lost frame, adjust the initial excitation adjustment factor according to a low-band signal energy of the previous frame of the current lost frame and a low-band signal energy of the current lost frame, to obtain the adjusted excitation adjustment factor.

With reference to the seventh possible implementation manner of the second aspect, in a thirteenth possible implementation manner of the second aspect, the gain adjustment information includes a class of the current lost frame, a low-band signal energy of the current lost frame, and a quantity of consecutive lost frames, and the adjustment module is configured to: when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of the previous frame of the current lost frame is unvoiced, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in a fourteenth possible implementation manner of the second aspect, the gain adjustment information includes a class of the current lost frame, a low-band signal energy of the current lost frame, and a quantity of consecutive lost frames, and the adjustment module is configured to: when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a class of a last normally received frame before the current lost frame is unvoiced, adjust the initial excitation adjustment factor according to the low-band signal energy of the previous frame of the current lost frame and the low-band signal energy of the current lost frame, to obtain the adjusted excitation adjustment factor.

With reference to the seventh possible implementation manner of the second aspect, in a fifteenth possible implementation manner of the second aspect, the gain adjustment information includes a low-band spectral tilt of the current lost frame, a low-band signal energy of the current lost frame, and a quantity of consecutive lost frames, and the adjustment module is configured to: when the quantity of consecutive lost frames is greater than 1, a high frequency excitation energy of the current lost frame is less than half a high frequency excitation energy of a previous frame of the current lost frame, an energy ratio of a low-band signal energy of the current lost frame to a low-band signal energy of the previous frame of the current lost frame is within a preset interval, and a low-band signal spectral tilt of the previous frame of the current lost frame is greater than a third threshold, adjust the initial excitation adjustment factor according to the low-band signal energy of the previous frame of the current lost frame and the low-band signal energy of the current lost frame, to obtain the adjusted excitation adjustment factor.

According to the method and the apparatus for recovering a lost frame provided in the embodiments of the present application, when a frame loss occurs in audio data, a high-band signal of a lost frame is adjusted according to a low-band signal of the lost frame, so that interframe variation trends of high and low frequency bands of a recovered lost frame are consistent, and performance of lost frame recovery is improved.

BRIEF DESCRIPTION OF DRAWINGS

The following briefly introduces the accompanying drawings used in describing the embodiments.

DESCRIPTION OF EMBODIMENTS

Currently, in order to encode a voice signal with wider bandwidth when a bit rate is unchanged or only changes slightly, bandwidth extension technologies are mainly used. A principle of a bandwidth extension technology is: A transmit end divides a signal into a high-frequency band (referred to as high-band) part and a low-frequency band (referred to as low-band) part, where the low-band part is encoded by using an encoder, and for the high-band part, only partial information and information such as related parameters of high and low frequency bands are extracted. A receive end recovers an entire voice signal according to a signal of the low-band part, related information of the high-band part, and the related parameters of the high and low frequency bands.

Generally, in the bandwidth extension technology, when a frame loss occurs during transmission of a voice signal, information of N frames (N is greater than or equal to 1) before the lost frame is used to recover the lost frame. A low-band part of the lost frame may be recovered according to low-band information of a previous frame of the lost frame, and a high-band part of the lost frame is recovered according to a global gain factor and a subframe gain attenuation factor of the voice signal. However, both the global gain factor and the subframe gain attenuation factor are obtained based on encoding of a high-band part of an original voice signal by an encoder, and a low-band part of the original voice signal is not used for lost frame recovery processing of the high-band part. However, when a frame loss occurs, if a low-band energy variation trend of the lost frame is inconsistent with a high-band energy variation trend, discontinuous energy transition between a recovered frame and frames before and after the recovered frame is caused, which causes noise in the voice signal.

Figure 1:
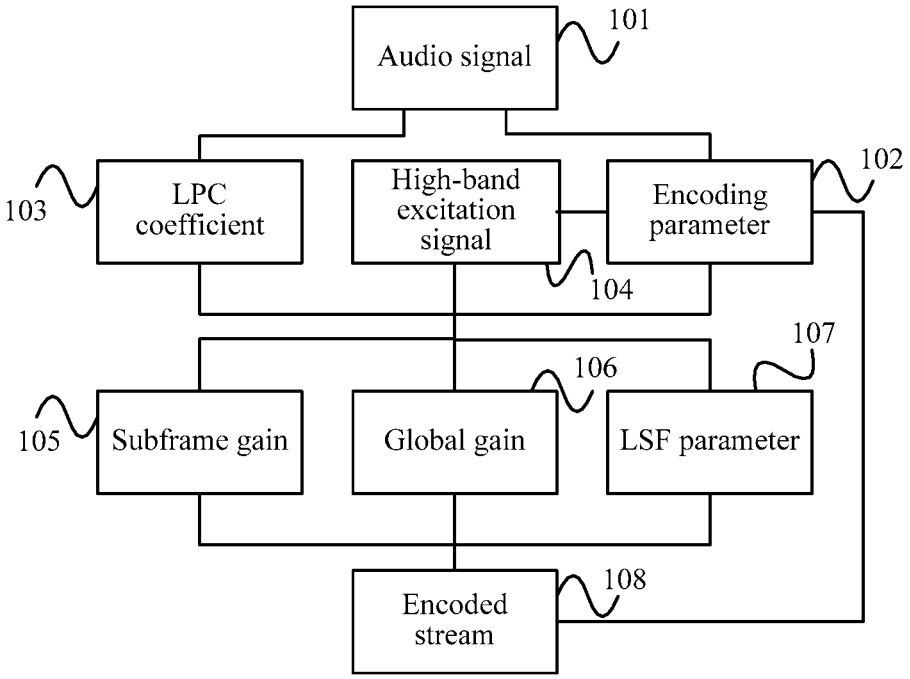
FIG. 1 is a principle diagram of encoding an audio signal by using a time domain bandwidth extension technology.
Figure 2:
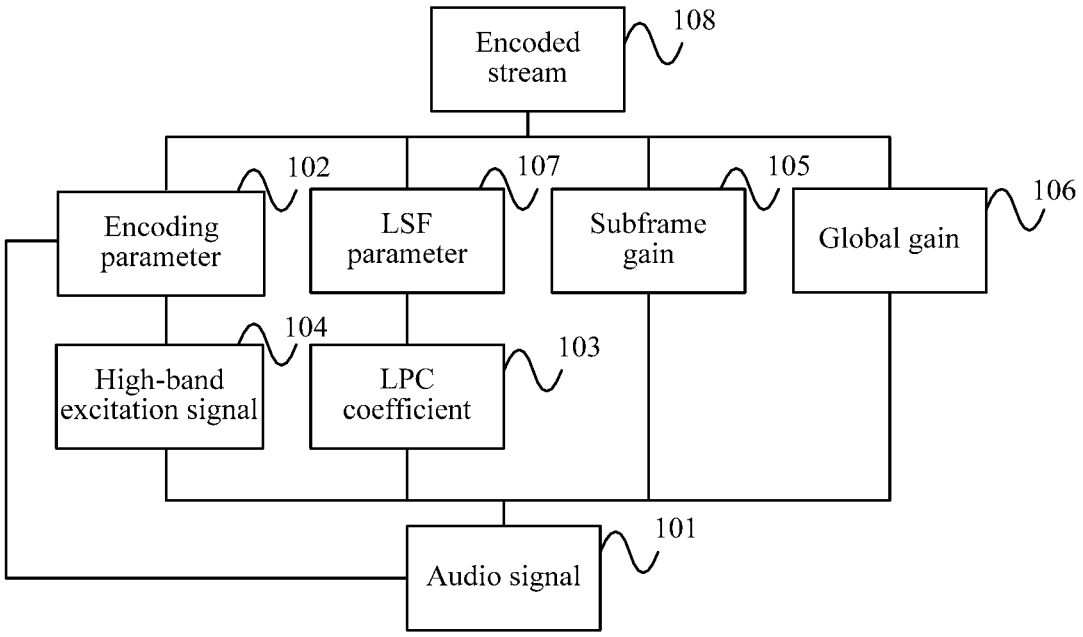
FIG. 2 is a principle diagram of decoding an audio signal by using a time domain bandwidth extension technology.

FIG. 1 is a principle diagram of encoding an audio signal by using a time domain bandwidth extension technology, and FIG. 2 is a principle diagram of decoding an audio signal by using a time domain bandwidth extension technology. As shown in FIG. 1 and FIG. 2, at an encoder side, first, the encoder collects an audio signal 101, where the audio signal 101 includes a low-band part and a high-band part. The low-band part and the high-band part are relative concepts. As long as the audio signal is divided into a part from 0 Hz to W1 Hz and a part from W1 Hz to W2 Hz according to frequencies, the part from 0 Hz to W1 Hz is the low-band part, and the part from W1 Hz to W2 Hz is the high-band part. For example, for an audio signal with an 8 kHz sampling frequency, a part from 0 kHz to 4 kHz may be used as a low-band part, and a part from 4 kHz to 8 kHz may be used as a high-band part. For an audio signal with a 16 kHz sampling frequency, a part from 0 kHz to 6 kHz may be used as a low-band part, and a part from 6 kHz to 16 kHz may be used as a high-band part. Then, the encoder obtains parameters of the low-band part of the audio signal 101 through calculation. These parameters include a pitch period, an algebraic code number, a gain, and the like of the audio signal 101, and may include one or more of the foregoing. For ease of description of the technical solutions of the present application, an encoding parameter 102 is used generally to represent the parameters. It may be understood that, the encoding parameter 102 is only an example used to help understand the embodiments of the present application, but does not mean a specific limitation to the parameter used by the encoder. For the high-band part of the audio signal 101, the encoder performs linear predictive coding (LPC) on the high-band part, to obtain a high-band LPC coefficient 103. A high-band excitation signal 104 is obtained through calculation according to the encoding parameter 102, the high-band LPC coefficient 103 is used as a filtering coefficient of an LPC synthesis filter, the high-band excitation signal 104 is synthesized into a high-band signal by using the LPC synthesis filter, and an original high-band part of the audio signal 101 and the synthesized high-band signal are compared to obtain a subframe gain (SubGain) 105 and a global gain (FramGain) 106. The global gain 106 is obtained by comparing an energy of an original high-band part of each frame of the audio signal 101 with an energy of the synthesized high-band signal, and the subframe gain 105 is obtained by comparing an energy of original high-band parts of subframes of each frame of the audio signal 101 with an energy of the synthesized high-band signal. The LPC coefficient 103 is converted into a linear spectral frequency (LSF) parameter 107, and the LSF parameter 107, the subframe gain 105, and the global gain 106 are encoded after being quantized. Finally, the encoder obtains an encoded stream 108 according to the encoding parameter 102, the encoded LSF parameter 107, the encoded subframe gain 105, and the encoded global gain 106, and sends the encoded stream 108 to a decoder.

At the decoder side, the decoder decodes the received encoded stream 108 to obtain parameters such as a pitch period, an algebraic code number, a gain, and the like of the voice signal, that is, the encoding parameter 102, and the decoder decodes and dequantizes the received encoded stream 108, to obtain the LSF parameter 107, the subframe gain 105, and the global gain 106, and converts the LSF parameter 107 into the LPC coefficient 103. The high-band excitation signal 104 is obtained through calculation according to the encoding parameter 102, the LPC 103 is used as a filtering coefficient of an LPC synthesis filter, the high-band excitation signal 104 is synthesized into a high-band signal by using the LPC synthesis filter, and the synthesized high-band signal is recovered to the high-band part of the audio signal 101 by means of adjustment of the subframe gain 105 and global gain 106, the low-band part of the audio signal 101 is obtained through decoding according to the encoding parameter 102, and the high-band part and the low-band part of the audio signal 101 are synthesized to obtain the original audio signal 101.

When a frame loss occurs during transmission of an audio signal, an encoding parameter and an LSF parameter of the lost frame are estimated according to an encoding parameter and an LSF parameter of a previous frame of the lost frame (for example, the encoding parameter and the LSF parameter of the previous frame of the lost frame are directly used as the encoding parameter and the LSF parameter of the lost frame), and a global gain and a subframe gain of the lost frame are estimated according to a global gain, a subframe gain, and an encoding type of the previous frame of the lost frame. In this way, the encoding parameter of the estimated lost frame may be decoded to recover a low-band part of the lost frame; and a high-band excitation signal of the lost frame is recovered according to the estimated encoding parameter, a high-band part of the lost frame is recovered according to the global gain and the subframe gain of the estimated lost frame, and the recovered low-band part and high-band part are synthesized into a signal of the lost frame.

As can be known according to the encoding and decoding principles of an audio signal shown in FIG. 1 and FIG. 2, the encoding parameter of the previous frame of the lost frame is used to recover the low-band part of the lost frame, the encoding parameter of the previous frame of the lost frame is directly obtained through encoding according to the low-band part of the previous frame of the lost frame, and the low-band part of the lost frame may be desirably recovered according to the encoding parameter. The global gain, the subframe gain, and the encoding type of the previous frame of the lost frame are used to recover the high-band part of the lost frame, and because the global gain and the subframe gain of the previous frame of the lost frame are obtained by means of processing such as encoding or computation, an error may occur in the recovered high-band part of the lost frame.

In a possible solution, a method for recovering the high-band part of the lost frame is to adjust a global gain factor and a subframe gain attenuation factor, and multiply the global gain factor and the subframe gain attenuation factor of the previous frame of the lost frame by a fixed attenuation factor and use the products as the global gain factor and the subframe gain attenuation factor of the lost frame.

In another possible solution, the global gain factor and the subframe gain attenuation factor of the lost frame are adaptively estimated by using an encoding type of the previous frame of the lost frame, an encoding type of a last normal frame before a frame loss occurs, a quantity of consecutive lost frames, and a global gain factor and a subframe gain attenuation factor of the previous frame of the lost frame. The global gain factor and the subframe gain attenuation factor are parameters related to a global gain and a subframe gain. High-band information and low-band information of the previous frame of the lost frame are used for initial recovery of a high-band part of a lost frame, and when the initially recovered high-band part of the lost frame is adjusted, only the high-band information of the previous frame of the lost frame is involved; when energy variation trends of the high-band part and the low-band part of the lost frame are inconsistent, the recovered lost frame causes discontinuous transition in an entire audio signal, which causes noise.

Embodiments of the present application provide a method and an apparatus for recovering a lost frame. On the basis of using a high-band part of an audio signal to recover a lost frame in the prior art, a gain and high frequency excitation of the lost frame are further adjusted according to a low-band part of the audio signal, so that variation trends of high and low frequency bands of a recovered lost frame are consistent, and performance of lost frame recovering is improved.

Embodiment 1

Figure 3:
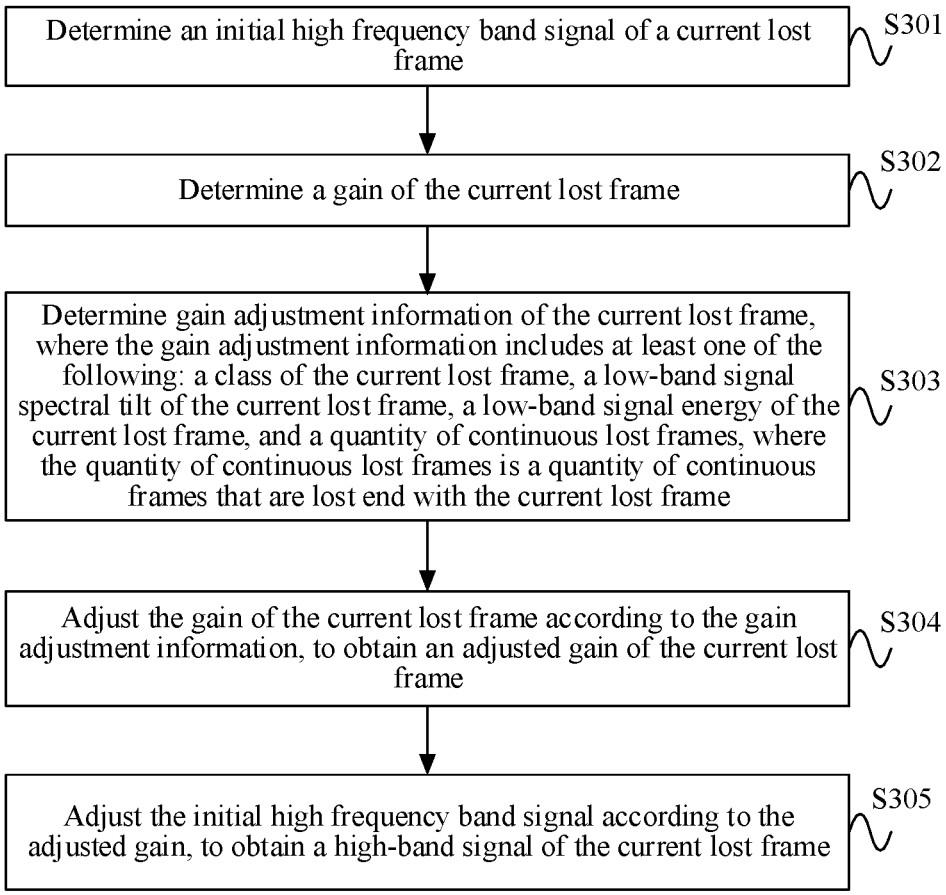
FIG. 3 is a flowchart of a method for recovering a lost frame according to embodiment 1 of the present application.

FIG. 3 is a flowchart of a method for recovering a lost frame according to embodiment 1 of the present application. As shown in FIG. 3, the method in this embodiment includes the following steps.

Step S301: Determine an initial high-band signal of a current lost frame.

The method for recovering a lost frame provided in this embodiment is applied to a receive end of an audio signal. First, the receive end of the audio signal receives audio data sent by a transmit end, where the audio data received by the receive end may be in a form of a data stream, or may be in a form of a data packet. When a frame loss occurs in the audio data received by the receive end, the receive end may detect the lost frame. The method for the receive end to determine whether a frame loss occurs in the received audio data may be any one method in the prior art. For example, a flag bit is set in each frame of the audio data, and the flag bit is 0 in a normal case. When a frame loss occurs, the flag bit is set to 1. When receiving the audio data, the receive end detects the flag bit in each frame, and when detecting that the flag bit is 1, the receive end may determine that a frame loss occurs. In another possible method, for example, frames of the audio data may be numbered sequentially, and if a sequence number of a current frame received by a decoder is not successive to a number of a previous received frame, it can be determined that a frame loss occurs. This embodiment does not limit the method for determining whether a frame loss occurs in received audio data.

After it is determined that a frame lost occurs in an audio signal, the lost frame needs to be recovered. The lost frame of the audio signal may be divided into a low-band signal part and a high-band signal part. First, low-band information of a previous frame of the current lost frame is used to recover low-band information of the current lost frame. An encoding parameter of the current lost frame is estimated according to an encoding parameter of the previous frame of the current lost frame, to estimate the low-band part of the current lost frame. It may be understood that, herein the previous frame of the lost frame may be a normally received frame, or may be a frame recovered according to a normally received frame. Then, a high-band excitation signal of the current lost frame is recovered according to the estimated encoding parameter of the current lost frame; a global gain and a subframe gain of the current lost frame are estimated according to a global gain, a subframe gain, and an encoding type of the previous frame of the current lost frame; and a high-band signal of the current lost frame is recovered according to the estimated global gain and subframe gain of the current lost frame.

The high-band signal of the current lost frame that is recovered according to the foregoing method is referred to as an initial high-band signal, and the following steps in this embodiment are adjusting the initial high-band signal, to recover a more accurate high-band signal of the current lost frame.

Step S302: Determine a gain of the current lost frame.

As can be known from step S301, the global gain and the subframe gain of the current lost frame may be estimated according to the global gain, the subframe gain, and the encoding type of the previous frame of the current lost frame. This embodiment is to adjust the high-band signal of the current lost frame, and the subframe gain directly affects the current lost frame; therefore, the gain of the current lost frame in this step and this embodiment is the subframe gain of the current lost frame.

Step S303: Determine gain adjustment information of the current lost frame, where the gain adjustment information includes at least one of the following: a class of the current lost frame, a low-band signal spectral tilt of the current lost frame, a low-band signal energy of the current lost frame, and a quantity of consecutive lost frames, where the quantity of consecutive lost frames is a quantity of consecutive frames that are lost end with the current lost frame.

This embodiment is to adjust the high-band signal of the current lost frame, and the high-band signal is obtained according to the high-band excitation signal and the gain; therefore, by adjusting the gain of the lost frame, the objective of adjusting the high-band signal of the current lost frame can be achieved. Gain adjustment information needs to be used to adjust the gain, where the gain adjustment information may include at least one of the following: a class of the current lost frame, a low-band signal spectral tilt of the current lost frame, a low-band signal energy of the current lost frame, and a quantity of consecutive lost frames.

The class of the frame may be obtained according to the encoding type of the previous frame of the current lost frame, and both the class of the frame and encoding type information are carried in the low-band signal part of the frame. The quantity of consecutive lost frames is a quantity of consecutive frames that are lost end with the current lost frame.

An encoding type before a frame loss may refer to an encoding mode before a current frame loss event occurs. Generally, in order to achieve better encoding performance, an encoder may classify signals before encoding the signals, to select a suitable encoding mode. Currently, the encoding mode may include: an inactive frame encoding mode (INACTIVE mode), an unvoiced frame encoding mode (UNVOICED mode), a voiced frame encoding mode (VOICED mode), a generic frame encoding mode (GENERIC mode), a transition frame encoding mode (TRANSITION mode), and an audio frame encoding mode (AUDIO mode).

A class of the last frame received before a frame loss may refer to a class of the latest frame received by the decoder before this frame loss event occurs. For example, assuming the encoder sends four frames to the decoder, where the decoder correctly receives the first frame and the second frame, but the third frame and the fourth frame are lost, the last frame received before the frame loss may refer to the second frame. Generally, the class of the frame may include: (1) a frame ended with one of the several features: unvoiced, inactive, noise, or voiced (UNVOICED_CLAS frame); (2) a frame with transition from an unvoiced consonant to a voiced consonant, and started with a relatively weak unvoiced consonant (UNVOICED_TRANSITION frame); (3) a frame with transition after a voiced consonant, where a voiced feature is quite weak (VOICED_TRANSITION frame); (4) a frame with a voiced feature, whose previous frames are voiced frames or frames starting with a voiced consonant (VOICED_CLAS frame); (5) a frame starting with an obvious voiced consonant (ONSET frame); (6) a frame starting with a mixture of harmonic and noise (SIN_ONSET frame); and (7) an inactive feature frame (INACTIVE_CLAS frame).

The quantity of consecutive lost frames may refer to a quantity of consecutive frames lost in this frame loss event, end with the current lost frame. In fact, the quantity of consecutive lost frames may indicate which frame of the consecutive lost frames the current lost frame is. For example, the encoder sends five frames to the decoder, and the decoder correctly receives the first frame and the second frame, but the third to the fifth frames are lost. If the current lost frame is the fourth frame, the quantity of consecutive lost frames is 2; and if the current lost frame is the fifth frame, the quantity of consecutive lost frames is 3.

The gain adjustment information including a class of the current lost frame, a low-band signal spectral tilt of the current lost frame, a low-band signal energy of the current lost frame, and a quantity of consecutive lost frames are obtained according to the low-band signal of the frame; therefore, in this embodiment, the gain of the frame is adjusted by using the low-band signal part of the signal.

Step S304: Adjust the gain of the current lost frame according to the gain adjustment information, to obtain an adjusted gain of the current lost frame.

The gain of the current lost frame may be adjusted according to the gain adjustment information. A specific adjustment method may be preset at a decoder of an audio signal, after determining the gain adjustment information, the decoder determines whether the gain adjustment information meets a corresponding preset condition, and if the corresponding preset condition is met, adjusts the gain of the current lost frame according to the adjustment method corresponding to the preset condition, and finally, obtains the adjusted gain of the current lost frame.

Step S305: Adjust the initial high-band signal according to the adjusted gain, to obtain a high-band signal of the current lost frame.

The initial high-band signal may be adjusted according to the adjusted gain, to obtain an adjusted high-band signal, that is, the high-band signal of the current lost frame. Generally, the high-band signal is a product of the high-band excitation signal and the gain; therefore, the high-band signal of the current lost frame may be obtained by multiplying the adjusted gain by the initial high-band signal.

Further, the high-band signal of the current lost frame that is obtained in step S305 and the low-band signal of the current lost frame that is recovered by using the encoding parameter of the previous frame of the current lost frame may be synthesized, to obtain the current lost frame, thereby completing recovery processing for the current lost frame. Because during recovery of the current lost frame, in addition to the recovery of the current lost frame by using a related parameter obtained by using the high-band signal, the receive end further recovers the current lost frame by using the low-band signal, so that interframe variation trends of high and low frequency bands of the recovered current lost frame are consistent, and performance of lost frame recovery is improved.

In this embodiment, when a frame loss occurs in audio data, the high-band signal of the lost frame is adjusted according to the low-band signal of the lost frame, so that interframe variation trends of high and low frequency bands of the recovered lost frame are consistent, and performance of lost frame recovery is improved.

A specific method for adjusting the gain of the current lost frame according to the gain adjustment information to obtain an adjusted gain of the current lost frame in the foregoing step S304 may be preset at the receive end of the audio signal. The following uses specific embodiments to further describe the method for adjusting the gain of the current lost frame according to the gain adjustment information.

Embodiment 2

Figure 4:
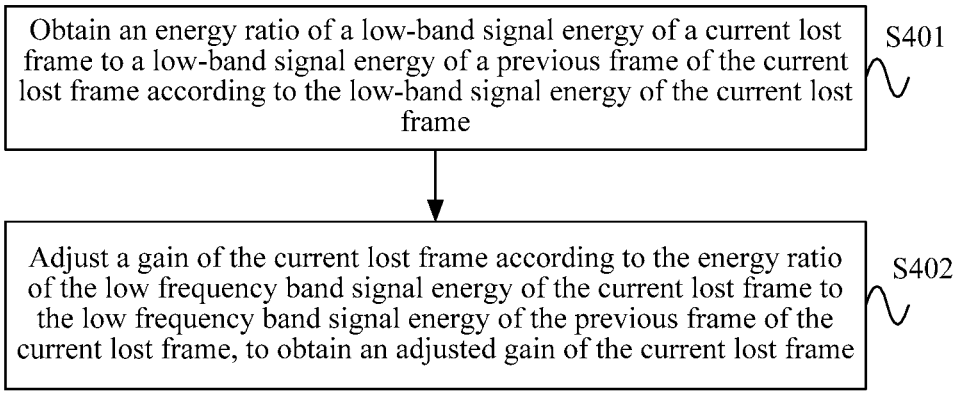
FIG. 4 is a flowchart of a method for recovering a lost frame according to embodiment 2 of the present application.

FIG. 4 is a flowchart of a method for recovering a lost frame according to embodiment 2 of the present application. As shown in FIG. 4, the method in this embodiment includes the following steps.

Step S401: Obtain an energy ratio of a low-band signal energy of the current lost frame to a low-band signal energy of a previous frame of the current lost frame according to the low-band signal energy of the current lost frame.

This embodiment is a further description of step S304. The gain adjustment information includes the band signal energy of the current lost frame. When the gain of the current lost frame is adjusted according to the gain adjustment information, the energy ratio of the low-band signal energy of the current lost frame to the low-band signal energy of the previous frame of the current lost frame is first acquired. The low-band signal energy of the current lost frame may be obtained according to the recovered low-band signal of the current lost frame, and the low-band signal of the previous frame of the current lost frame may also be obtained according to the low-band signal energy of the previous frame of the current lost frame.

Step S402: Adjust the gain of the current lost frame according to the energy ratio of the low-band signal energy of the current lost frame to the low-band signal energy of the previous frame of the current lost frame, to obtain an adjusted gain of the current lost frame.

The energy ratio of the low-band signal energy of the current lost frame to the low-band signal energy of the previous frame of the current lost frame reflects a variation trend of the low-band signal energy of the current lost frame; therefore, the gain of the current lost frame is adjusted according to the energy ratio of the low-band signal energy of the current lost frame to the low-band signal energy of the previous frame of the current lost frame, and the obtained adjusted gain reflects a variation trend of the low-band signal of the current lost frame. Therefore, adjustment of the high-band signal of the current lost frame by using the adjusted gain obtained in this embodiment can make interframe variation trends of high and low frequency bands of the current lost frame consistent, and improve performance of lost frame recovery.

Embodiment 3

Figure 5:
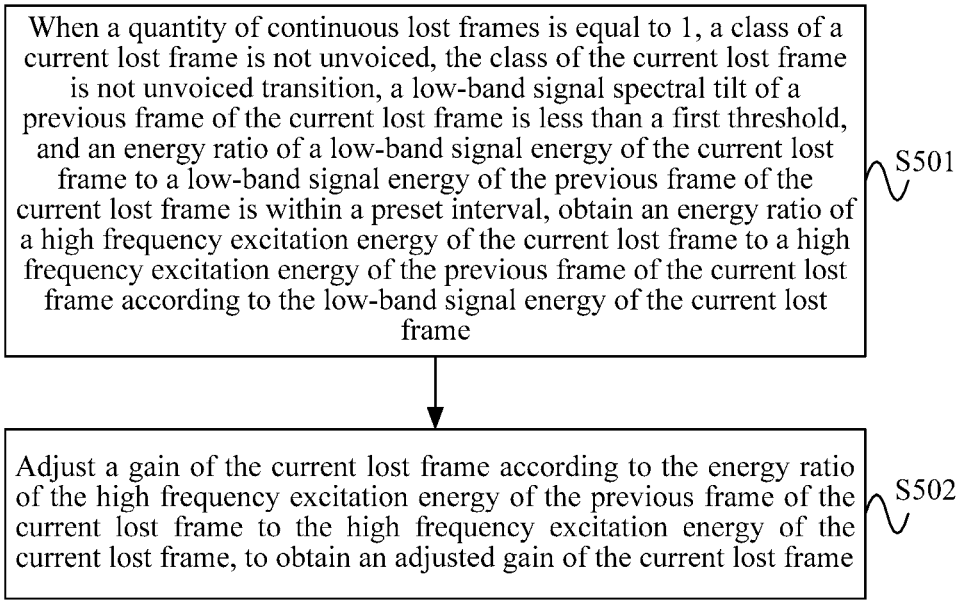
FIG. 5 is a flowchart of a method for recovering a lost frame according to embodiment 3 of the present application.

FIG. 5 is a flowchart of a method for recovering a lost frame according to embodiment 3 of the present application. As shown in FIG. 5, the method in this embodiment includes the following steps.

Step S501: When the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, obtain an energy ratio of the high frequency excitation energy of the current lost frame to the high frequency excitation energy of the previous frame of the current lost frame according to the low-band signal energy of the current lost frame.

This embodiment is a further description of step S304. The gain adjustment information includes a class of the current lost frame, a low-band signal spectral tilt of the current lost frame, a low-band signal energy of the current lost frame, and a quantity of consecutive lost frames. When the gain of the current lost frame is adjusted according to the gain adjustment information, it is determined first whether the gain adjustment information meets the following conditions: the quantity of consecutive lost frames is equal to 1, the class of the current lost frame is not unvoiced (UNVOICED_CLAS), the class of the current lost frame is not unvoiced transition (UNVOICED_TRANSITION), the low-band signal spectral tilt of the previous frame of the current lost frame is less than a first threshold, and the energy ratio of the low-band signal energy of the current lost frame to the low-band signal energy of the previous frame of the current lost frame is within a preset interval.

The low-band signal spectral tilt is a slope of a low-band signal spectrum, and the first threshold may be a preset value. For example, the first threshold in this embodiment may be set to 8. The meaning that the low-band signal spectral tilt of the previous frame of the current lost frame is less than a first threshold lies in that the low-band signal of the previous frame of the current lost frame cannot change excessively fast lest precision of correcting the gain of the current lost frame by using the low-band signal is reduced. The meaning that the energy ratio of the low-band signal energy of the current lost frame to the low-band signal energy of the previous frame of the current lost frame is within a preset interval lies in that the difference between the low-band signal energy of the current lost frame and the low-band signal energy of the previous frame of the current lost frame cannot be excessively large lest precision of correcting the current lost frame is affected. The preset interval may be generally so set that the low-band signal energy of the current lost frame is greater than half the low-band signal energy of the previous frame of the current lost frame, and the low-band signal energy of the current lost frame is less than two times the low-band signal energy of the previous frame of the current lost frame. In addition, a determining condition further needs to be added that the low-band signal spectral tilt of the current lost frame is less than or equal to the low-band signal spectral tilt of the previous frame of the current lost frame.

Step S502: Adjust the gain of the current lost frame according to the energy ratio of the high frequency excitation energy of the previous frame of the current lost frame to the high frequency excitation energy of the current lost frame, to obtain an adjusted gain of the current lost frame.

When the gain adjustment information meets the condition in step S501, the gain of the current lost frame is adjusted according to the energy ratio of the high frequency excitation energy of the current lost frame to the high frequency excitation energy of the previous frame of the current lost frame. Let prev_ener_ratio denote a ratio of the high frequency excitation energy of the previous frame of the lost frame to the high frequency excitation energy ratio of the lost frame. In this case, the gain of the current lost frame is adjusted again according to a relationship between prev_ener_ratio and the gain of the current lost frame. For example, in this embodiment, let the gain of the current lost frame be G, and the adjusted gain of the current lost frame be G'. When prev_ener_ratio is greater than four times G, $G'=0.4\times prev_ener_ratio+0.6\times G$; when prev_ener_ratio is greater than two times G but less than or equal to four times G, $G'=0.8\times prev_ener_ratio+0.2\times G$; and when prev_ener_ratio is less than or equal to two times G, $G'=0.2\times prev_ener_ratio+0.8\times G$.

Embodiment 4

Figure 6:
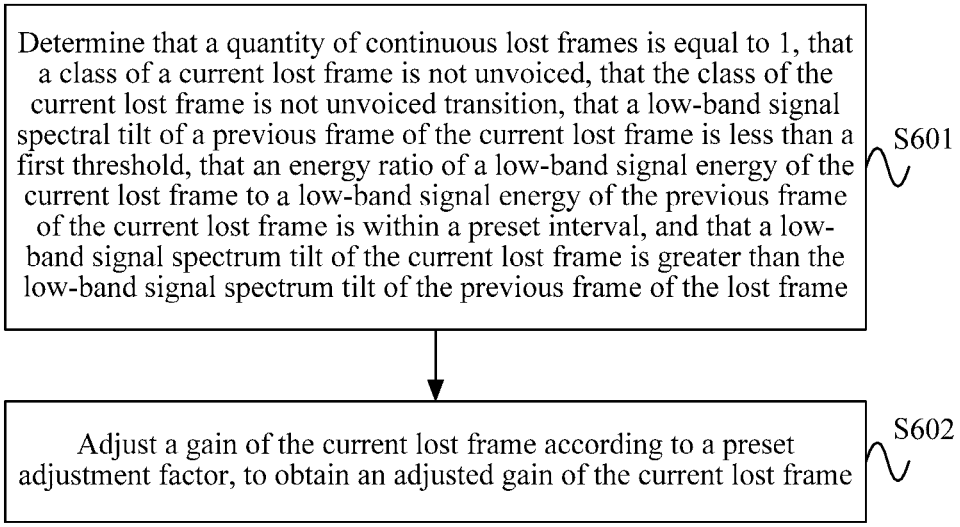
FIG. 6 is a flowchart of a method for recovering a lost frame according to embodiment 4 of the present application.

FIG. 6 is a flowchart of a method for recovering a lost frame according to embodiment 4 of the present application. As shown in FIG. 6, the method in this embodiment includes the following steps.

Step S601: Determine that the quantity of consecutive lost frames is equal to 1, that a class of the current lost frame is not unvoiced, that the class of the current lost frame is not unvoiced transition, that a low-band signal spectral tilt of a previous frame of the current lost frame is less than a first threshold, that an energy ratio of a low-band signal energy of the current lost frame to a low-band signal energy of the previous frame of the current lost frame is within a preset interval, and that a low-band signal spectral tilt of the current lost frame is greater than the low-band signal spectral tilt of the previous frame of the lost frame.

This embodiment is a further description of step S304. The gain adjustment information includes a class of the current lost frame, a low-band signal spectral tilt of the current lost frame, a low-band signal energy of the current lost frame, and a quantity of consecutive lost frames. When the gain of the current lost frame is adjusted according to the gain adjustment information, it is determined first whether the gain adjustment information meets the following conditions: the quantity of consecutive lost frames is equal to 1, the class of the current lost frame is not unvoiced (UNVOICED_CLAS), the class of the current lost frame is not unvoiced transition (UNVOICED_TRANSITION), the low-band signal spectral tilt of the previous frame of the current lost frame is less than a first threshold, and the energy ratio of the low-band signal energy of the current lost frame to the low-band signal energy of the previous frame of the current lost frame is within a preset interval.

The low-band signal spectral tilt is a slope of a low-band signal spectrum, and the first threshold may be a preset value. For example, the first threshold in this embodiment may be set to 8. The meaning that the low-band signal spectral tilt of the previous frame of the current lost frame is less than a first threshold lies in that the low-band signal of the previous frame of the current lost frame cannot change excessively fast lest precision of correcting the gain of the current lost frame by using the low-band signal is reduced. The meaning that the energy ratio of the low-band signal energy of the current lost frame to the low-band signal energy of the previous frame of the current lost frame is within a preset interval lies in that the difference between the low-band signal energy of the current lost frame and the low-band signal energy of the previous frame of the current lost frame cannot be excessively large lest precision of correcting the current lost frame is affected. The preset interval may be generally so set that the low-band signal energy of the current lost frame is greater than half the low-band signal energy of the previous frame of the current lost frame, and the low-band signal energy of the current lost frame is less than two times the low-band signal energy of the previous frame of the current lost frame. In addition, a determining condition further needs to be added that a low-band signal spectral tilt of the current lost frame is greater than a low-band signal spectral tilt of the previous frame of the current lost frame.

Step S602: Adjust the gain of the current lost frame according to a preset adjustment factor, to obtain an adjusted gain of the current lost frame.

When the gain adjustment information meets the condition in step S601, the gain of the current lost frame is adjusted according to a preset adjustment factor. $G'=G\times f$ where f is a preset adjustment factor, and f is equal to a ratio of the low-band signal spectral tilt of the current lost frame to the low-band signal spectral tilt of the previous frame of the current lost frame.

Embodiment 5

Figure 7:
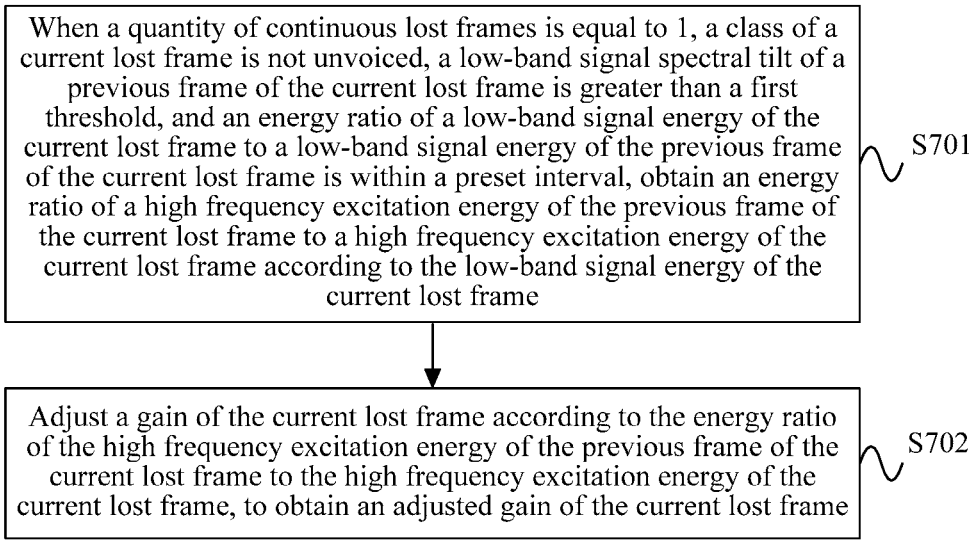
FIG. 7 is a flowchart of a method for recovering a lost frame according to embodiment 5 of the present application.

FIG. 7 is a flowchart of a method for recovering a lost frame according to embodiment 5 of the present application. As shown in FIG. 7, the method in this embodiment includes the following steps.

Step S701: When the quantity of consecutive lost frames is equal to 1, and a class of the current lost frame is not unvoiced, a low-band signal spectral tilt of a previous frame of the current lost frame is greater than a first threshold, and an energy ratio of a low-band signal energy of the current lost frame to a low-band signal energy of the previous frame of the current lost frame is within a preset interval, obtain an energy ratio of a high frequency excitation energy of the previous frame of the current lost frame to a high frequency excitation energy of the current lost frame according to the low-band signal energy of the current lost frame.

This embodiment is a further description of step S304. The gain adjustment information includes a class of the current lost frame, a low-band signal spectral tilt of the current lost frame, and a quantity of consecutive lost frames. When the gain of the current lost frame is adjusted according to the gain adjustment information, it is determined first whether the gain adjustment information meets the following conditions: the quantity of consecutive lost frames is equal to 1, the class of the current lost frame is not unvoiced, the low-band signal spectral tilt of the previous frame of the current lost frame is greater than a first threshold, and the energy ratio of the low-band signal energy of the current lost frame to the low-band signal energy of the previous frame of the current lost frame is within a preset interval.

The low-band signal spectral tilt is a slope of a low-band signal spectrum, and the first threshold may be a preset value. For example, the first threshold in this embodiment may be set to 8. The meaning that the low-band signal spectral tilt of the previous frame of the current lost frame is greater than a first threshold lies in that the low-band signal of the previous frame of the current lost frame changes relatively fast; in this case, a weight of correcting the gain of the current lost frame by using the low-band signal is reduced. The meaning that the energy ratio of the low-band signal energy of the current lost frame to the low-band signal energy of the previous frame of the current lost frame is within a preset interval lies in that the difference between the low-band signal energy of the current lost frame and the low-band signal energy of the previous frame of the current lost frame cannot be excessively large lest precision of correcting the current lost frame is affected. The preset interval may be generally set as that the low-band signal energy of the current lost frame is greater than half the low-band signal energy of the previous frame of the current lost frame, and the low-band signal energy of the current lost frame is less than two times the low-band signal energy of the previous frame of the current lost frame.

Step S702: Adjust the gain of the current lost frame according to the energy ratio of the high frequency excitation energy of the previous frame of the current lost frame to the high frequency excitation energy of the current lost frame, to obtain an adjusted gain of the current lost frame.

When the gain adjustment information meets the condition in step S701, the gain of the current lost frame is adjusted according to the energy ratio of the high frequency excitation energy of the current lost frame to the high frequency excitation energy of the previous frame of the current lost frame. For example, in this embodiment, $G'=0.2\times prev_ener_ratio+0.8\times G$.

Embodiment 6

Figure 8:
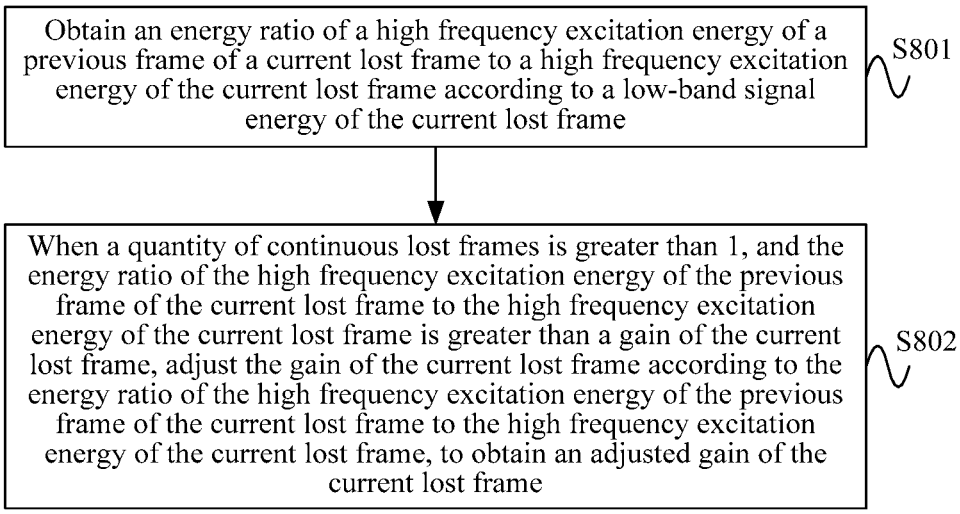
FIG. 8 is a flowchart of a method for recovering a lost frame according to embodiment 6 of the present application.

FIG. 8 is a flowchart of a method for recovering a lost frame according to embodiment 6 of the present application. As shown in FIG. 8, the method in this embodiment includes the following steps.

Step S801: Obtain an energy ratio of a high frequency excitation energy of a previous frame of the current lost frame to a high frequency excitation energy of the current lost frame according to the low-band signal energy of the current lost frame.

This embodiment is a further description of step S304. The gain adjustment information includes the quantity of consecutive lost frames. First, the energy ratio of the high frequency excitation energy of the previous frame of the current lost frame to the high frequency excitation energy of the current lost frame is obtained according to the low-band signal energy of the current lost frame.

Step S802: When the quantity of consecutive lost frames is greater than 1, and the energy ratio of the high frequency excitation energy of the previous frame of the current lost frame to the high frequency excitation energy of the current lost frame is greater than the gain of the current lost frame, adjust the gain of the current lost frame according to the energy ratio of the high frequency excitation energy of the previous frame of the current lost frame to the high frequency excitation energy of the current lost frame, to obtain the adjusted gain of the current lost frame.

When the gain of the current lost frame is adjusted according to the gain adjustment information, it is determined first whether the gain adjustment information meets the following conditions: the quantity of consecutive lost frames is greater than 1, and the energy ratio of the high frequency excitation energy of the previous frame of the current lost frame to the high frequency excitation energy of the current lost frame is greater than the gain of the current lost frame. Moreover, another condition further needs to be determined: whether the low-band signal spectral tilt of the current lost frame and a low-band signal spectral tilt of the previous frame of the current lost frame are both less than or equal to a second threshold, where the second threshold may be a preset threshold, for example, 10. If the foregoing conditions are all met, the gain of the current lost frame is adjusted according to the energy ratio of the high frequency excitation energy of the previous frame of the current lost frame to the high frequency excitation energy of the current lost frame. For example, when $prev_ener_ratio>4G$, $G'=\min((0.5\times prev_ener_ratio+0.5\times G),4\times G)$, which indicates that G' is equal to a lesser one of $0.5\times prev_ener_ratio+0.5\times G$ and $4\times G$; and when $4G>prev_ener_ratio>G$, $0.8\times prev_ener_ratio+0.2\times G$.

Embodiment 7

Figure 9:
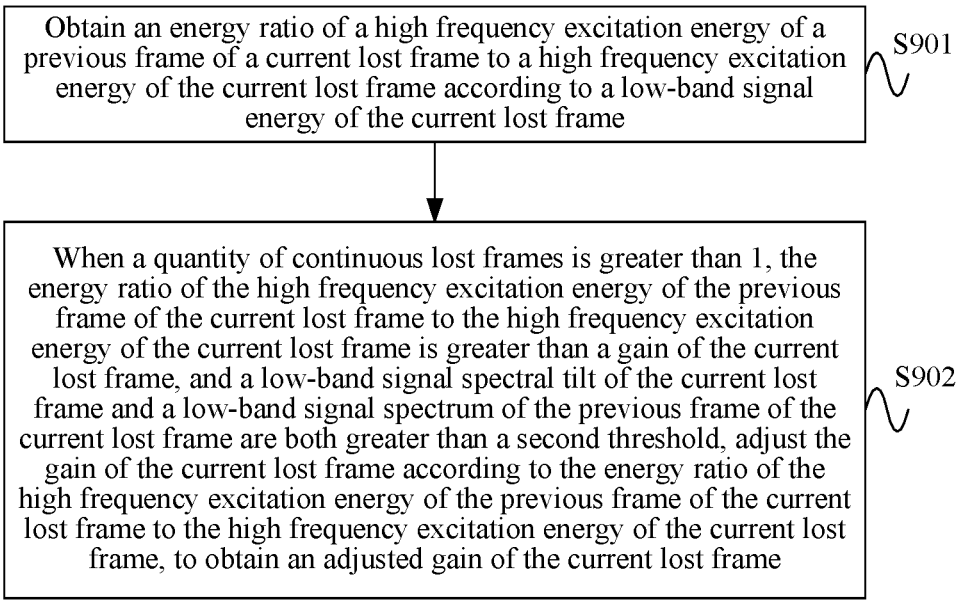
FIG. 9 is a flowchart of a method for recovering a lost frame according to embodiment 7 of the present application.

FIG. 9 is a flowchart of a method for recovering a lost frame according to embodiment 7 of the present application. As shown in FIG. 9, the method in this embodiment includes the following steps.

Step S901: Obtain an energy ratio of a high frequency excitation energy of a previous frame of the current lost frame to a high frequency excitation energy of the current lost frame according to the low-band signal energy of the current lost frame.

This embodiment is a further description of step S304. The gain adjustment information includes a quantity of consecutive lost frames and the low-band signal spectral tilt of the current lost frame. First, the energy ratio of the high frequency excitation energy of the previous frame of the current lost frame to the high frequency excitation energy of the current lost frame is obtained according to the low-band signal energy of the current lost frame.

Step S902: When the quantity of consecutive lost frames is greater than 1, the energy ratio of the high frequency excitation energy of the previous frame of the current lost frame to the high frequency excitation energy of the current lost frame is greater than the gain of the current lost frame, and the low-band signal spectral tilt of the current lost frame and a low-band signal spectral tilt of the previous frame of the current lost frame are both greater than a second threshold, adjust the gain of the current lost frame according to the energy ratio of the high frequency excitation energy of the previous frame of the current lost frame to the high frequency excitation energy of the current lost frame, to obtain the adjusted gain of the current lost frame.

When the gain of the current lost frame is adjusted according to the gain adjustment information, it is determined first whether the gain adjustment information meets the following conditions: the quantity of consecutive lost frames is greater than 1 and the energy ratio of the high frequency excitation energy of the previous frame of the current lost frame to the high frequency excitation energy of the current lost frame is greater than the gain of the current lost frame. Moreover, another condition further needs to be determined: whether the low-band signal spectral tilt of the current lost frame and a low-band signal spectral tilt of the previous frame of the current lost frame are both greater than a second threshold, where the second threshold may be a preset threshold, for example, 10. If the foregoing conditions are all met, the gain of the current lost frame is adjusted according to the energy ratio of the high frequency excitation energy of the previous frame of the current lost frame to the high frequency excitation energy of the current lost frame. For example, when prev_ener_ratio>4G, G'=min((0.8×prev_ener_ratio+0.2×G),4×G), which indicates that G' is equal to a lesser one of 0.8×prev_ener_ratio+0.2×G and 4×G; and when 4G>prev_ener_ratio>G, 0.5× prev_ener_ratio+0.5×G.

On a Windows 7 platform, a Microsoft Visual Studio 2008 compilation environment is used, and the method for recovering a lost frame in the embodiments shown in FIG. 5 to FIG. 9 may be implemented by using the following code:

```
if( st->nbLostCmpt == 1 )
{
  prev_ener_ratio = st->prev_ener_shb/ener;
  if( st->clas_dec != UNVOICED_CLAS && st->clas_dec !=
      UNVOICED_TRANSITION &&st->tilt_swb_fec < 8.0 &&
       ((st->enerLL > 0.5f*st->prev_enerLL && st->enerLL <
      2.0f*st->prev_enerLL)|| (st->enerLH > 0.5f*st->prev_enerLH
      && st->enerLH < 2.0f*st->prev_enerLH)))
  {
    if( prev_ener_ratio > 4.0f * GainFrame )
    {
      GainFrame = 0.4f * prev_ener_ratio + 0.6f * GainFrame;
    }
    else if( prev_ener_ratio > 2.0f * GainFrame )
    {
      GainFrame = 0.8f * prev_ener_ratio + 0.2f * GainFrame;
    }
    else
    {
      GainFrame = 0.2f * prev_ener_ratio + 0.8f * GainFrame;
    }
    if( tilt_swb_fec > st->tilt_swb_fec )
    {
      GainFrame *= st->tilt_swb_fec > 0 ?
            (min(5.0f,tilt_swb_fec/st->tilt_swb_fec)): 1.0f;
      }
    }
    else if( (st->clas_dec != UNVOICED_CLAS ||
      st->tilt_swb_fec > 8.0) && prev_ener_ratio > 4.0f *
      GainFrame &&
      (st->enerLL > 0.5f*st->prev_enerLL ||st->enerLH >
      0.5f*st->prev_enerLH) )
    {
      GainFrame = 0.2f * prev_ener_ratio + 0.8f * GainFrame;
    }
  }
  else if( st->nbLostCmpt > 1 )
  {
    prev_ener_ratio = st->prev_ener_shb/ener;
    if(prev_ener_ratio > 4.0 * GainFrame )
    {
      if( tilt_swb_fec > 10.0f && st->tilt_swb_fec > 10.0f )
      {
```

-continued

```
        GainFrame = min((prev_ener_ratio *0.8f + GainFrame *
        0.2f),4.0f * GainFrame);
      }
      else
      {
        GainFrame = min((prev_ener_ratio *0.5f +
        GainFrame * 0.5f),4.0f * GainFrame);
      }
    }
    else if( prev_ener_ratio > GainFrame )
    {
      if( tilt_swb_fec > 10.0f && st->tilt_swb_fec >10.0f )
      {
        GainFrame = 0.5f * prev_ener_ratio + 0.5f * GainFrame;
      }
      else
      {
        GainFrame = 0.2f * prev_ener_ratio + 0.8f * GainFrame;
      }
  }
```

Embodiment 8

Figure 10:
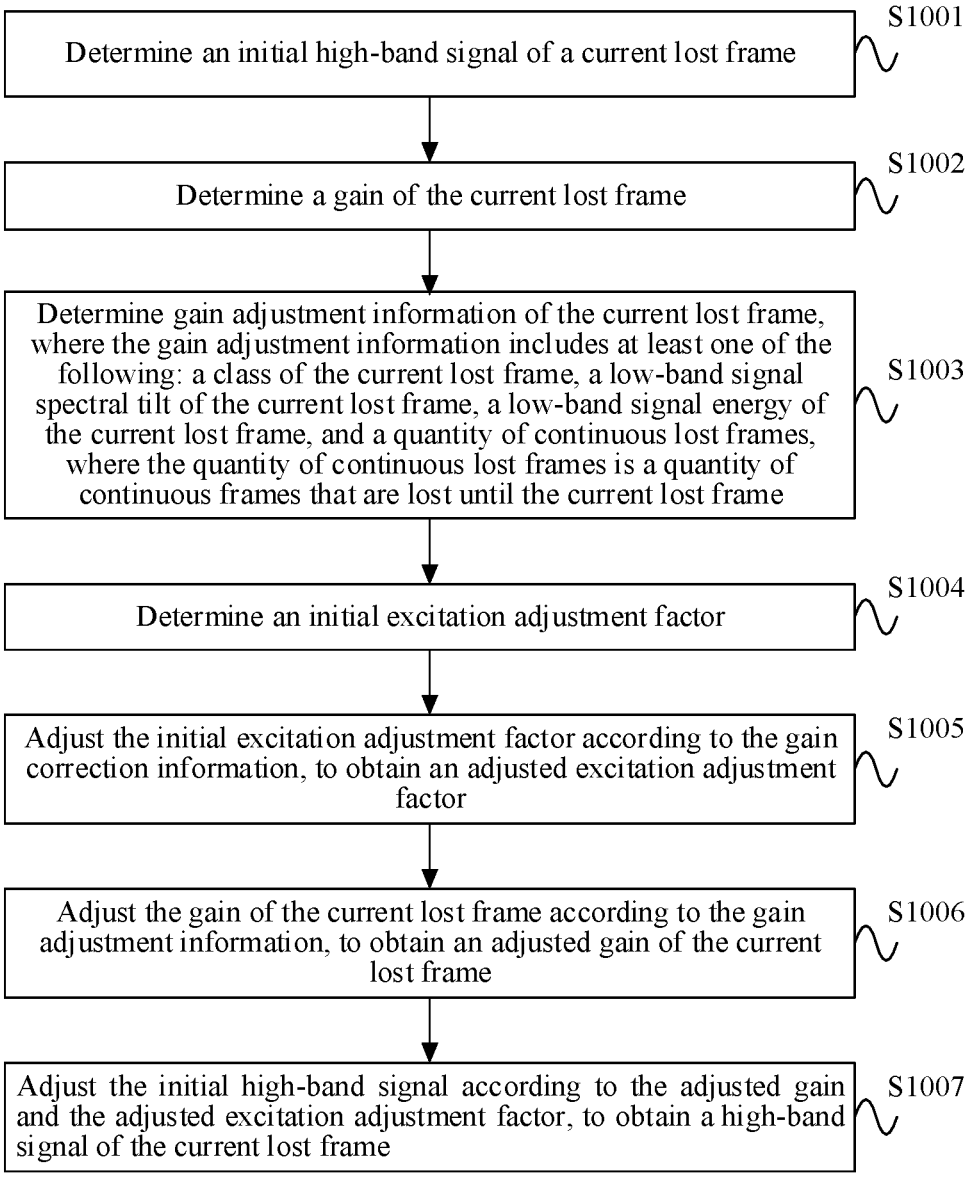
FIG. 10 is a flowchart of a method for recovering a lost frame according to embodiment 8 of the present application.

FIG. 10 is a flowchart of a method for recovering a lost frame according to embodiment 8 of the present application. As shown in FIG. 10, the method in this embodiment includes the following steps.

Step S1001: Determine an initial high-band signal of a current lost frame.

Step S1002: Determine a gain of the current lost frame.

Step S1003: Determine gain adjustment information of the current lost frame, where the gain adjustment information includes at least one of the following: a class of the current lost frame, a low-band signal spectral tilt of the current lost frame, a low-band signal energy of the current lost frame, and a quantity of consecutive lost frames, where the quantity of consecutive lost frames is a quantity of consecutive frames that are lost end with the current lost frame.

Step S1004: Determine an initial excitation adjustment factor.

On the basis of the embodiment shown in FIG. 3, in this embodiment, a high-band excitation signal of the current lost frame is further adjusted, to adjust the current lost frame more accurately. The excitation adjustment factor refers to a factor used for adjusting the high-band excitation signal of the current lost frame, and the initial excitation adjustment factor is obtained according to a subframe gain and a global gain of the lost frame.

Step S1005: Adjust the initial excitation adjustment factor according to the gain adjustment information, to obtain an adjusted excitation adjustment factor.

The initial excitation adjustment factor may be adjusted according to the gain adjustment information. A specific adjustment method may be preset at a decoder of an audio signal, after determining the gain adjustment information, the decoder determines the gain adjustment information, and if a corresponding preset condition is met, adjusts the initial excitation adjustment factor according to the adjustment method corresponding to the preset condition, and finally, obtains the adjusted initial excitation adjustment factor.

It should be noted that, in order to ensure interframe energy continuity in a frame loss case, smooth incremental processing needs to be performed on the adjusted excitation adjustment factor, for example, a formula: scale'=pow(scale', 0.125) may be used for calculation. That is, scale' to the power of 0.125 is acquired.

Step S1006: Adjust the gain of the current lost frame according to the gain adjustment information, to obtain an adjusted gain of the current lost frame.

Step S1007: Adjust the initial high-band signal according to the adjusted gain and the adjusted excitation adjustment factor, to obtain a high-band signal of the current lost frame.

Generally, the high-band signal is a product of the high-band excitation signal and the gain; therefore, the high-band excitation signal may be adjusted according to the excitation adjustment factor, and the high-band excitation signal is also adjusted according to the adjusted gain, to finally obtain the high-band signal of the current lost frame.

Further, in step S1005, a specific method for adjusting the initial excitation adjustment factor according to the gain adjustment information, to obtain an adjusted excitation adjustment factor may be shown in the following implementation manners.

In a possible implementation manner, step S1005 includes: when the quantity of consecutive lost frames is equal to 1, the high frequency excitation energy of the current lost frame is greater than the high frequency excitation energy of the previous frame of the current lost frame, the class of the current lost frame is not unvoiced, and a class of a last normally received frame before the current lost frame is not unvoiced, adjusting the initial excitation adjustment factor according to the low-band signal energy of the previous frame of the current lost frame and the low-band signal energy of the current lost frame, to obtain the adjusted excitation adjustment factor, where the gain adjustment information includes a class of the current lost frame, a low-band signal energy of the current lost frame, and the quantity of consecutive lost frames.

The gain adjustment information includes a class of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is equal to 1, the high frequency excitation energy of the current lost frame is greater than the high frequency excitation energy of the previous frame of the current lost frame, a class of the current lost frame is not unvoiced, and a class of a last normally received frame before the current lost frame is not unvoiced. If it is determined that all the foregoing conditions are met, the initial excitation adjustment factor is adjusted according to the low-band signal energy of the previous frame of the current lost frame and the low-band signal energy of the lost frame. The last normally received frame before the current lost frame indicates a last frame that is not lost before the current lost frame. For example, it is assumed that the initial excitation adjustment factor is scale, and the adjusted excitation adjustment factor is scale'. Therefore, scale' is equal to a ratio of low-band energy of the previous frame of the current lost frame to low-band energy of the current lost frame.

In another possible implementation manner, step S1005 includes: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced, adjusting the initial excitation adjustment factor according to the low-band signal energy of the previous frame of the current lost frame and the low-band signal energy of the current lost frame, to obtain the adjusted excitation adjustment factor.

The gain adjustment information includes a class of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced. The preset interval may be generally so set that the low-band signal energy of the current lost frame is greater than half the low-band signal energy of the previous frame of the current lost frame, and the low-band signal energy of the current lost frame is less than two times the low-band signal energy of the previous frame of the current lost frame. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is equal to a ratio of low-band energy of the previous frame of the current lost frame to low-band energy of the current lost frame.

In another possible implementation manner, step S1005 includes: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced, adjusting the initial excitation adjustment factor according to the low-band signal energy of the previous frame of the current lost frame and the low-band signal energy of the current lost frame, to obtain the adjusted excitation adjustment factor.

The gain adjustment information includes a class of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced. The last normally received frame before the current lost frame indicates a last frame that is not lost before the current lost frame. The preset interval may be generally so set that the low-band signal energy of the current lost frame is greater than half the low-band signal energy of the previous frame of the current lost frame, and the low-band signal energy of the current lost frame is less than two times the low-band signal energy of the previous frame of the current lost frame. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is equal to a ratio of low-band energy of the previous frame of the current lost frame to low-band energy of the current lost frame.

In another possible implementation manner, step S1005 includes: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold, adjusting the initial excitation adjustment factor according to the low-band signal energy of the previous frame of the current lost frame and the low-band signal energy of the current lost frame, to obtain the adjusted excitation adjustment factor.

The gain adjustment information includes a low-band spectral tilt of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold. The preset interval may be generally set as that the low-band signal energy of the current lost frame is greater than half the low-band signal energy of the previous frame of the current lost frame, and the low-band signal energy of the current lost frame is less than two times the low-band signal energy of the previous frame of the current lost frame; and the third threshold may be a preset threshold, for example, 5. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is equal to a ratio of a low-band energy of the previous frame of the current lost frame to a low-band energy of the current lost frame.

In another possible implementation manner, step S1005 includes: when the quantity of consecutive lost frames is greater than 1, and the high frequency excitation energy of the current lost frame is greater than the high frequency excitation energy of the previous frame of the current lost frame, adjusting the initial excitation adjustment factor according to the low-band signal energy of the previous frame of the current lost frame and the low-band signal energy of the current lost frame, to obtain the adjusted excitation adjustment factor.

The gain adjustment information includes a low-band signal energy of the current lost frame and a quantity of consecutive lost frames. When the initial excitation adjustment factor is adjusted according to the gain adjustment information, it is determined first whether the gain adjustment information meets all the following conditions: the quantity of consecutive lost frames is greater than 1, and the high frequency excitation energy of the current lost frame is greater than the high frequency excitation energy of the previous frame of the current lost frame. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is equal to a ratio of a low-band energy of the previous frame of the current lost frame to a low-band energy of the current lost frame.

In another possible implementation manner, step S1005 includes: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced, adjusting the initial excitation adjustment factor according to the low-band signal energy of the previous frame of the current lost frame and the low-band signal energy of the current lost frame, to obtain the adjusted excitation adjustment factor.

The gain adjustment information includes a class of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced. The preset interval may be generally set as that the low-band signal energy of the current lost frame is greater than half the low-band signal energy of the previous frame of the current lost frame, and the low-band signal energy of the current lost frame is less than two times the low-band signal energy of the previous frame of the current lost frame. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is a lesser one of a ratio of a low-band energy of the previous frame of the current lost frame to a low-band energy of the current lost frame, and 3.

In another possible implementation manner, step S1005 includes: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced, adjusting the initial excitation adjustment factor according to the low-band signal energy of the previous frame of the current lost frame and the low-band signal energy of the current lost frame, to obtain the adjusted excitation adjustment factor.

The gain adjustment information includes a class of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced. The last normally received frame before the current lost frame indicates a last frame that is not lost before the current lost frame. The preset interval may be generally set as that the low-band signal energy of the current lost frame is greater than half the low-band signal energy of the previous frame of the current lost frame, and the low-band signal energy of the current lost frame is less than two times the low-band signal energy of the previous frame of the current lost frame. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is a lesser one of a ratio of a low-band energy of the previous frame of the current lost frame to a low-band energy of the current lost frame, and 3.

In another possible implementation manner, step S1005 includes: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold, adjusting the initial excitation adjustment factor according to the low-band signal energy of the previous frame of the current lost frame and the low-band signal energy of the current lost frame, to obtain the adjusted excitation adjustment factor.

The gain adjustment information includes a low-band spectral tilt of the current lost frame, a low-band signal energy of the current lost frame, and a quantity of consecutive lost frames. When the initial excitation adjustment factor is adjusted according to the gain adjustment information, it is determined first whether the gain adjustment information meets all the following conditions: the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold. The preset interval may be generally set as that the low-band signal energy of the current lost frame is greater than half the low-band signal energy of the previous frame of the current lost frame, and the low-band signal energy of the current lost frame is less than two times the low-band signal energy of the previous frame of the current lost frame; and the third threshold may be a preset threshold, for example, 5. If it is determined that all the foregoing conditions are met, the initial excitation adjustment factor is adjusted according to the low-band signal energy of the previous frame of the current lost frame and the low-band signal energy of the lost frame. For example, it is assumed that the initial excitation adjustment factor is scale, and the adjusted excitation adjustment factor is scale'. Therefore, scale' is a lesser one of a ratio of a low-band energy of the previous frame of the current lost frame to a low-band energy of the current lost frame, and 3.

On a Windows 7 platform, a Microsoft Visual Studio 2008 compilation environment is used, and the method for recovering a lost frame in the embodiment shown in FIG. 10 and the implementation manners in the embodiment shown FIG. 10 may be implemented by using the following code:

```
if( st->bfi )
{
  scale = 1.0f;
  temp = 1.0f;
  if (st->nbLostCmpt == 1 )
  {
    if( curr_frame_pow > st->prev_swb_bwe_frame_pow &&
      st->prev_coder_type != UNVOICED &&
      st->last_good != UNVOICED_CLAS )
    {
      scale = root_a_over_b( st->prev_swb_bwe_frame_pow, curr_frame_pow );
      temp = (float) pow( scale, 0.125f );
    }
    else if( curr_frame_pow < 0.5f *st->prev_swb_bwe_frame_pow &&
st->nbLostCmpt == 1 &&
      (st->enerLL > 0.5 * st->prev_enerLL || st->enerLH > 0.5 *st->prev_enerLH) &&
      (st->prev_coder_type == UNVOICED || st->last_good == UNVOICED_CLAS ||
st->tilt_swb_fec > 5.0f) )
    {
```

-continued

```
                scale = root_a_over_b(st->prev_swb_bwe_frame_pow, curr_frame_pow);
                temp = (float) pow(scale, 0.125f);
              }
            }
            else if ( st->nbLostCmpt > 1 )
            {
              if( curr_frame_pow > st->prev_swb_bwe_frame_pow )
              {
                scale = root_a_over_b( st->prev_swb_bwe_frame_pow, curr_frame_pow );
                temp = (float) pow( scale, 0.125f );
              }
              else if( curr_frame_pow < 0.5f *st->prev_swb_bwe_frame_pow &&
                (st->enerLL > 0.5 * st->prev_enerLL || st->enerLH > 0.5 *st->prev_enerLH) &&
                (st->prev_coder_type == UNVOICED || st->last_good == UNVOICED_CLAS ||
st->tilt_swb_fec > 5.0f) )
              {
                scale=min(3.0f,root_a_over_b(st->prev_swb_bwe_frame_pow,
curr_frame_pow));
                temp = (float) pow(scale, 0.125f);
              }
            }
            for( j=0; j<8; j++ )
            {
              GainShape[2 * j] *= scale;
              GainShape[2 * j + 1] *= scale;
              for( i=0; i<L_FRAME16k/8; i++ )
              {
                shaped_shb_excitation[i + j * L_FRAME16k/8] *= scale;
              }
              scale /= temp;
            }
          }
```

In the method for recovering a lost frame provided in this embodiment, only a specific method for correcting a gain of a lost frame and an excitation adjustment factor by using information such as low-band signal spectral tilt of the lost frame and a previous frame of the lost frame, a low-band signal energy ratio, a high frequency excitation energy ratio, and a frame class of the lost frame. However, the method for recovering a lost frame provided in the present application is not limited thereto, as long as a lost frame recovering method for correcting high-band information of the lost frame according to low-band information and encoding type information of the lost frame and at least one frame before the lost frame falls within the protection scope of the present application.

According to the method for recovering a lost frame provided in this embodiment of the present application, lost frame recovery of a high-band is guided based on a low-band correlation between consecutive frames, and such a method can make a high-band energy of a recovered lost frame more continuous in a case in which low-band information is recovered accurately, thereby resolving a case of discontinuous high-band energy recovery, and improving high-band performance of the lost frame.

Figure 11:
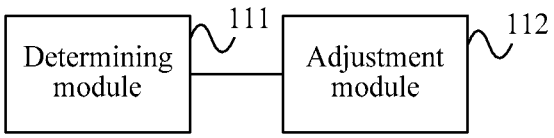
FIG. 11 is a functional block diagram of an apparatus for recovering a lost frame according to an embodiment of the present application.

FIG. 11 is a schematic structural diagram of an apparatus for recovering a lost frame according to an embodiment of the present application. As shown in FIG. 11, the apparatus for recovering a lost frame in this embodiment includes:

a determining module 111, configured to determine an initial high-band signal of a current lost frame; determine a gain of the current lost frame; and determine gain adjustment information of the current lost frame, where the gain adjustment information includes at least one of the following: a class of the current lost frame, a low-band signal spectral tilt of the current lost frame, a low-band signal energy of the current lost frame, and a quantity of consecutive lost frames, where the quantity of consecutive lost frames is a quantity of consecutive frames that are lost end with the current lost frame; and an adjustment module 112, configured to adjust the gain of the current lost frame according to the gain adjustment information, to obtain an adjusted gain of the current lost frame; and adjust the initial high-band signal according to the adjusted gain, to obtain a high-band signal of the current lost frame.

The apparatus for recovering a lost frame provided in this embodiment may be used to execute the technical solutions of the method embodiment shown in FIG. 3, and has similar implementation principles and technical effects, and details are not described herein again.

Further, in the embodiment shown in FIG. 11, the gain adjustment information includes a low-band signal energy of the current lost frame, and the adjustment module 112 is configured to obtain an energy ratio of a low-band signal energy of the current lost frame to a low-band signal energy of a previous frame of the current lost frame according to the low-band signal energy of the current lost frame; and adjust the gain of the current lost frame according to the energy ratio of the low-band signal energy of the current lost frame to the low-band signal energy of the previous frame of the current lost frame, to obtain the adjusted gain of the current lost frame.

Further, in the embodiment shown in FIG. 11, the gain adjustment information includes a class of the current lost frame, a low-band signal spectral tilt of the current lost frame, a low-band signal energy of the current lost frame, and a quantity of consecutive lost frames, and the adjustment module 112 is configured to: when the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, and an energy ratio of a low-band signal energy of the current lost frame to a low-band signal energy of the previous frame of the current lost frame is within a preset interval, obtain an energy ratio of a high frequency excitation energy of the previous frame of the current lost frame to a high frequency excitation energy of the current lost frame according to the low-band signal energy of the current lost frame; and adjust the gain of the current lost frame according to the energy ratio of the high frequency excitation energy of the previous frame of the current lost frame to the high frequency excitation energy of the current lost frame, to obtain the adjusted gain of the current lost frame.

Further, in the embodiment shown in FIG. 11, the gain adjustment information includes a class of the current lost frame, a low-band signal spectral tilt of the current lost frame, a low-band signal energy of the current lost frame, and a quantity of consecutive lost frames, and the adjustment module 112 is configured to: when the quantity of consecutive lost frames is equal to 1, a class of the current lost frame is not unvoiced, the class of the current lost frame is not unvoiced transition, a low-band signal spectral tilt of a previous frame of the current lost frame is less than a first threshold, an energy ratio of a low-band signal energy of the current lost frame to a low-band signal energy of the previous frame of the current lost frame is within a preset interval, and a low-band signal spectral tilt of the current lost frame is greater than the low-band signal spectral tilt of the previous frame of the lost frame, adjust the gain of the current lost frame according to a preset adjustment factor, to obtain the adjusted gain of the current lost frame.

Further, in the embodiment shown in FIG. 11, the gain adjustment information includes a class of the current lost frame, a low-band signal spectral tilt of the current lost frame, and a quantity of consecutive lost frames, and the adjustment module 112 is configured to: when the quantity of consecutive lost frames is equal to 1, and a class of the current lost frame is not unvoiced, a low-band signal spectral tilt of a previous frame of the current lost frame is greater than a first threshold, and an energy ratio of a low-band signal energy of the current lost frame to a low-band signal energy of the previous frame of the current lost frame is within a preset interval, obtain an energy ratio of a high frequency excitation energy of the previous frame of the current lost frame to a high frequency excitation energy of the current lost frame according to the low-band signal energy of the current lost frame; and adjust the gain of the current lost frame according to the energy ratio of the high frequency excitation energy of the previous frame of the current lost frame to the high frequency excitation energy of the current lost frame, to obtain the adjusted gain of the current lost frame.

Further, in the embodiment shown in FIG. 11, the gain adjustment information includes a quantity of consecutive lost frames, and the adjustment module 112 is configured to: obtain an energy ratio of a high frequency excitation energy of a previous frame of the current lost frame to a high frequency excitation energy of the current lost frame according to a low-band signal energy of the current lost frame; and when the quantity of consecutive lost frames is greater than 1 and the energy ratio of the high frequency excitation energy of the previous frame of the current lost frame to the high frequency excitation energy of the current lost frame is greater than the gain of the current lost frame, adjust the gain of the current lost frame according to the energy ratio of the high frequency excitation energy of the previous frame of the current lost frame to the high frequency excitation energy of the current lost frame, to obtain the adjusted gain of the current lost frame.

Further, in the embodiment shown in FIG. 11, the gain adjustment information includes a quantity of consecutive lost frames and a low-band signal spectral tilt of the current lost frame, and the adjustment module 112 is configured to obtain an energy ratio of a high frequency excitation energy of a previous frame of the current lost frame to a high frequency excitation energy of the current lost frame according to a low-band signal energy of the current lost frame; and when the quantity of consecutive lost frames is greater than 1, the energy ratio of the high frequency excitation energy of the previous frame of the current lost frame to the high frequency excitation energy of the current lost frame is greater than the gain of the current lost frame, and the low-band signal spectral tilt of the current lost frame and a low-band signal spectral tilt of the previous frame of the current lost frame are both greater than a second threshold, adjust the gain of the current lost frame according to the energy ratio of the high frequency excitation energy of the previous frame of the current lost frame to the high frequency excitation energy of the current lost frame, to obtain the adjusted gain of the current lost frame.

Further, in the embodiment shown in FIG. 11, the determining module 111 is further configured to determine an initial excitation adjustment factor; and the adjustment module 112 is further configured to adjust the initial excitation adjustment factor according to the gain adjustment information, to obtain an adjusted excitation adjustment factor; and adjust the initial high-band signal according to the adjusted gain and the adjusted excitation adjustment factor, to obtain the high-band signal of the current lost frame.

Further, in the embodiment shown FIG. 11, the gain adjustment information includes a class of the current lost frame, a low-band signal energy of the current lost frame, and a quantity of consecutive lost frames, and the adjustment module 112 is configured to: when the quantity of consecutive lost frames is equal to 1, the high frequency excitation energy of the current lost frame is greater than the high frequency excitation energy of the previous frame of the current lost frame, the class of the current lost frame is not unvoiced, and a class of a last normally received frame before the current lost frame is not unvoiced, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a class of the current lost frame, a low-band signal energy of the current lost frame, and a quantity of consecutive lost frames, and the adjustment module 112 is configured to: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a class of the current lost frame, a low-band signal energy of the current lost frame, and a quantity of consecutive lost frames, and the adjustment module 112 is configured to: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a low-band spectral tilt of the current lost frame, a low-band signal energy of the current lost frame, and a quantity of consecutive lost frames, and the adjustment module 112 is configured to: when the quantity of consecutive lost frames is equal to 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a low-band signal energy of the current lost frame and a quantity of consecutive lost frames, and the adjustment module 112 is configured to: when the quantity of consecutive lost frames is greater than 1, and the high frequency excitation energy of the current lost frame is greater than the high frequency excitation energy of the previous frame of the current lost frame, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a class of the current lost frame, a low-band signal energy of the current lost frame, and a quantity of consecutive lost frames, and the adjustment module 112 is configured to: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of the previous frame of the current lost frame is unvoiced, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a class of the current lost frame, a low-band signal energy of the current lost frame, and a quantity of consecutive lost frames, and the adjustment module 112 is configured to: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and a class of a last normally received frame before the current lost frame is unvoiced, adjust the initial excitation adjustment factor according to the low-band signal energy of the previous frame of the current lost frame and the low-band signal energy of the current lost frame, to obtain the adjusted excitation adjustment factor.

Further, in the embodiment shown in FIG. 11, the gain adjustment information includes a low-band spectral tilt of the current lost frame, a low-band signal energy of the current lost frame, and a quantity of consecutive lost frames, and the adjustment module 112 is configured to: when the quantity of consecutive lost frames is greater than 1, the high frequency excitation energy of the current lost frame is less than half the high frequency excitation energy of the previous frame of the current lost frame, the energy ratio of the low-band signal energy of the current lost frame to the low-band signal energy of the previous frame of the current lost frame is within a preset interval, and the low-band signal spectral tilt of the previous frame of the current lost frame is greater than a third threshold, adjust the initial excitation adjustment factor according to the low-band signal energy of the previous frame of the current lost frame and the low-band signal energy of the current lost frame, to obtain the adjusted excitation adjustment factor.

Persons of ordinary skill in the art may understand that all or a part of the steps of the method embodiments may be implemented by a program instructing relevant hardware. The program may be stored in a computer readable storage medium. When the program runs, the steps of the method embodiments are performed. The foregoing storage medium includes: any medium that can store program encode, such as a ROM, a RAM, a magnetic disc, or an optical disc.

Finally, it should be noted that the foregoing embodiments are merely intended for describing the technical solutions of the present application other than limiting the present application. Although the present application is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present application.

The invention claimed is:

1. A method for recovering lost frames in an audio signal, performed by an audio signal decoder, comprising:

receiving and decoding a bit stream to obtain the audio signal, wherein the audio signal is transmitted in consecutive frames, and wherein at least one frame of the audio signal is lost;

obtaining an initial high-frequency band signal of a current lost frame of the audio signal;

calculating a ratio R, wherein the ratio R is a ratio of a high frequency excitation energy of a previous frame of the current lost frame to a high frequency excitation energy of the current lost frame;

obtaining a global gain of the current lost frame according to the ratio R and a global gain of the previous frame of the current lost frame;

obtaining a high-frequency band signal of the current lost frame according to the initial high-frequency band signal of the current lost frame and the global gain of the current lost frame;

reconstructing the current lost frame of the audio signal according to the high-frequency band signal of the current lost frame; and outputting the audio signal including the reconstructed current lost frame.

2. The method according to claim 1, wherein obtaining the global gain of the current lost frame according to the ratio R and the global gain of the previous frame of the current lost frame comprises:

obtaining the global gain of the current lost frame according to the following formula:

$$G'=\alpha\times R+(1-\alpha)\times G,$$

where G' is the global gain of the current lost frame, wherein G is the global gain of the previous frame of the current lost frame, wherein $\alpha$ is a weighting factor, and wherein $\alpha$ is greater than or equal to 0 and smaller than 1.

3. The method according to claim 1, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\alpha\times R+(1-\alpha)\times G,$$

where G' is the global gain of the current lost frame, wherein G is the initial gain, wherein $\alpha$ is a weighting factor, and wherein $\alpha$ is greater than or equal to 0 and smaller than 1.

4. The method according to claim 1, wherein obtaining the global gain of the current lost frame according to the ratio R and the global gain of the previous frame of the current lost frame comprises:

obtaining an initial gain according to the global gain of the previous frame of the current lost frame; and one of:

if the ratio R is greater than two times of the initial gain and less than or equal to four times of the initial gain, obtaining the global gain of the current lost frame according to the following formula:

$$G'=0.4\times R+0.6\times G;$$

if the ratio R is greater than four times of the initial gain, obtaining the global gain of the current lost frame according to the following formula:

$$G'=0.8\times R+0.2\times G;\text{ or}$$

if the ratio R is less than or equal to two times of the initial gain, obtaining the global gain of the current lost frame according to the following formula:

$$G'=0.2\times R+0.8\times G;$$

wherein G' is the global gain of the current lost frame, and wherein G is the initial gain.

5. The method according to claim 1, wherein obtaining the global gain of the current lost frame according to the ratio R and the global gain of the previous frame of the current lost frame comprises one of:

if the ratio R is greater than two times and less than or equal to four times of the global gain of the previous frame, obtaining the global gain of the current lost frame according to the following formula:

$$G'=0.4\times R+0.6\times G;$$

if the ratio R is greater than four times of the global gain of the previous frame, obtaining the global gain of the current lost frame according to the following formula:

$$G'=0.8\times R+0.2\times G;\text{ or}$$

if the ratio R is less than or equal to two times of the global gain of the previous frame, obtaining the global gain of the current lost frame according to the following formula:

$$G'=0.2\times R+0.8\times G;$$

wherein G' is the global gain of the current lost frame, and wherein G is the global gain of the previous frame of the current lost frame.

6. The method according to claim 1, wherein obtaining the global gain of the current lost frame according to the ratio R and the global gain of the previous frame of the current lost frame comprises:

obtaining the global gain of the current lost frame according to the following formula:

$$G'=\min((0.5\times R+0.5\times G),4\times G),$$

where G' is the global gain of the current lost frame, and where G is the global gain of the previous frame of the current lost frame.

7. The method according to claim 1, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\min((0.5\times R+0.5\times G),4\times G),$$

where G' is the global gain of the current lost frame, and where G is the initial gain.

8. The method according to claim 1, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\min((0.8\times R+0.2\times G),4\times G),$$

where G' is the global gain of the current lost frame, and where G is the initial gain.

9. An audio signal decoding apparatus, comprising:

at least one processor; and a storage medium storing programming instructions which, when executed by the at least one processor, cause the audio signal decoding apparatus to perform a process of recovering lost frames in an audio signal, and wherein the process comprises:

receiving and decoding a bit stream to obtain the audio signal, wherein the audio signal is transmitted in consecutive frames, and wherein at least one frame of the audio signal is lost;

obtaining an initial high-frequency band signal of a current lost frame of the audio signal;

calculating a ratio R, wherein the ratio R is a ratio of a high frequency excitation energy of a previous frame of the current lost frame to a high frequency excitation energy of the current lost frame;

obtaining a global gain of the current lost frame according to the ratio R and a global gain of the previous frame of the current lost frame;

obtaining a high-frequency band signal of the current lost frame according to the initial high-frequency band signal of the current lost frame and the global gain of the current lost frame;

reconstructing the current lost frame of the audio signal according to the high-frequency band signal of the current lost frame; and outputting the audio signal including the reconstructed current lost frame.

10. The apparatus according to claim 9, wherein obtaining the global gain of the current lost frame according to the ratio R and the global gain of the previous frame of the current lost frame comprises:

obtaining the global gain of the current lost frame according to the following formula:

$$G'=\alpha\times R+(1-\alpha)\times G,$$

where G' is the global gain of the current lost frame, wherein G is the global gain of the previous frame of the current lost frame, wherein $\alpha$ is a weighting factor, and wherein $\alpha$ is greater than or equal to 0 and smaller than 1.

11. The apparatus according to claim 9, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\alpha\times R+(1-\alpha)\times G,$$

where G' is the global gain of the current lost frame, wherein G is the initial gain, wherein $\alpha$ is a weighting factor, and wherein $\alpha$ is greater than or equal to 0 and smaller than 1.

12. The apparatus according to claim 9, wherein obtaining the global gain of the current lost frame according to the ratio R and the global gain of the previous frame of the current lost frame comprises:

obtaining an initial gain according to the global gain of the previous frame of the current lost frame; and one of:

if the ratio R is greater than two times of the initial gain and less than or equal to four times of the initial gain, obtaining the global gain of the current lost frame according to the following formula:

$$G'=0.4\times R+0.6\times G;$$

if the ratio R is greater than four times of the initial gain, obtaining the global gain of the current lost frame according to the following formula:

$$G'=0.8\times R+0.2\times G;\text{ or}$$

if the ratio R is less than or equal to two times of the initial gain, obtaining the global gain of the current lost frame according to the following formula:

$$G'=0.2\times R+0.8\times G;$$

wherein G' is the global gain of the current lost frame, and wherein G is the initial gain.

13. The apparatus according to claim 9, wherein obtaining the global gain of the current lost frame according to the ratio R and the global gain of the previous frame of the current lost frame comprises one of:

if the ratio R is greater than two times and less than or equal to four times of the global gain of the previous frame, obtaining the global gain of the current lost frame according to the following formula:

$$G'=0.4\times R+0.6\times G;$$

if the ratio R is greater than four times of the global gain of the previous frame, obtaining the global gain of the current lost frame according to the following formula:

$$G'=0.8\times R+0.2\times G;\text{ or}$$

if the ratio R is less than or equal to two times of the global gain of the previous frame, obtaining the global gain of the current lost frame according to the following formula:

$$G'=0.2\times R+0.8\times G;$$

wherein G' is the global gain of the current lost frame, and wherein G is the global gain of the previous frame.

14. The apparatus according to claim 9, wherein obtaining the global gain of the current lost frame according to the ratio R and the global gain of the previous frame of the current lost frame comprises:

obtaining the global gain of the current lost frame according to the following formula:

$$G'=\min((0.5\times R+0.5\times G),4\times G),$$

where G' is the global gain of the current lost frame, and wherein G is the global gain of the previous frame of the current lost frame.

15. The apparatus according to claim 9, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\min((0.5\times R+0.5\times G),4\times G),$$

where G' is the global gain of the current lost frame, and wherein G is the initial gain.

16. The apparatus according to claim 9, wherein obtaining the global gain of the current lost frame according to the ratio R and the global gain of the previous frame of the current lost frame comprises:

obtaining an initial gain according to the global gain of the previous frame of the current lost frame; and obtaining the global gain of the current lost frame according to the following formula:

$$G'=\min((0.8\times R+0.2\times G),4\times G),$$

where G' is the global gain of the current lost frame, and wherein G is the initial gain.

* * * * *